US008542166B2

(12) United States Patent
Murata et al.

(10) Patent No.: US 8,542,166 B2
(45) Date of Patent: Sep. 24, 2013

(54) ELECTROLUMINESCENCE DISPLAY APPARATUS WITH VIDEO SIGNAL REWRITING

(75) Inventors: Tsutomu Murata, Mizuho (JP); Takashi Ogawa, Gifu (JP)

(73) Assignees: Sanyo Semiconductor Co., Ltd. (JP); Semiconductor Components Industries, LLC, Phoenix, AZ (US)

( * ) Notice: Subject to any disclaimer, the term of this patent is extended or adjusted under 35 U.S.C. 154(b) by 1049 days.

(21) Appl. No.: 11/959,663

(22) Filed: Dec. 19, 2007

(65) Prior Publication Data

US 2008/0303754 A1 Dec. 11, 2008

(30) Foreign Application Priority Data

Dec. 22, 2006 (JP) ..... 2006-346450

(51) Int. Cl.
*G09G 3/30* (2006.01)

(52) U.S. Cl.
USPC ..... 345/77; 345/76; 345/78

(58) Field of Classification Search
USPC ..... 345/36, 76–84, 204–215, 690–699; 315/169.1–169.3
See application file for complete search history.

(56) References Cited

U.S. PATENT DOCUMENTS 4,811,190 A * 3/1989 Keir et al. ..... 363/60
5,563,839 A * 10/1996 Herdt et al. ..... 365/227
6,204,610 B1 * 3/2001 Komiya ..... 315/169.3
6,229,508 B1 5/2001 Kane
6,310,617 B1 * 10/2001 Nunokawa et al. ..... 345/211
6,608,620 B1 8/2003 Suzuki et al.
7,009,590 B2 * 3/2006 Numao ..... 345/76
7,863,824 B2 * 1/2011 Yamazaki et al. ..... 315/169.1
2002/0180721 A1 12/2002 Kimura et al.
2003/0057895 A1 3/2003 Kimura
2003/0063053 A1 4/2003 Yamazaki et al.
2003/0201727 A1 * 10/2003 Yamazaki et al. ..... 315/169.1
2005/0237318 A1 * 10/2005 Inoue et al. ..... 345/207
2005/0259099 A1 * 11/2005 Jo et al. ..... 345/211

(Continued)

FOREIGN PATENT DOCUMENTS

JP 10-254410 A 9/1998
JP 11-219146 A 8/1999

(Continued)

OTHER PUBLICATIONS

Office Action for U.S. Appl. No. 11/859,158 dated Jul. 14, 2010.

(Continued)

*Primary Examiner* — Bipin Shalwala
*Assistant Examiner* — Keith Crawley
(74) *Attorney, Agent, or Firm* — Cantor Colburn LLP

(57) ABSTRACT

In performing a display in accordance with a video signal, a display signal for inspection is supplied to a pixel within a predetermined inspected row to operate an EL element therein and to thereby detect a current that flows through the EL element. The current detection data is stored in a volatile primary memory. In accordance with data obtained in this manner, a variation correcting section sequentially corrects data signals to be supplied to the respective pixel. At the time of turning on power, the variation correcting section performs the correction using the current detection data saved in a secondary memory. With this arrangement, it is possible to execute display variation correction from immediately after turning on power, and it is also possible to execute real-time correction.

13 Claims, 17 Drawing Sheets

(56) References Cited

U.S. PATENT DOCUMENTS

| | | | | |
|---|---|---|---|---|
| 2006/0184590 | A1* | 8/2006 | Frank et al. | 707/202 |
| 2006/0202924 | A1* | 9/2006 | Koyama | 345/76 |
| 2006/0290618 | A1 | 12/2006 | Goto | |
| 2007/0168698 | A1* | 7/2007 | Coulson et al. | 714/5 |
| 2009/0066614 | A1* | 3/2009 | Ishii et al. | 345/76 |
| 2009/0184984 | A1* | 7/2009 | Takahara | 345/690 |
| 2010/0265277 | A1* | 10/2010 | Takahara | 345/690 |

FOREIGN PATENT DOCUMENTS

| | | | |
|---|---|---|---|
| JP | 2000-20020 | A | 1/2000 |
| JP | 2002-278513 | A | 9/2002 |
| JP | 2003-177713 | A | 6/2003 |
| JP | 2003-195813 | A | 7/2003 |
| JP | 2004-38209 | A | 2/2004 |
| JP | 2004-38210 | A | 2/2004 |
| JP | 2004-101767 | A | 4/2004 |
| JP | 2005-84260 | A | 3/2005 |
| JP | 2005-316408 | | 11/2005 |
| JP | 2006-106122 | A | 4/2006 |
| JP | 2006-195313 | A | 7/2006 |
| WO | 98/40871 | A1 | 9/1998 |

OTHER PUBLICATIONS

Notice of Grounds for Rejection for Patent Application No. 2006-256123 mailed on Nov. 30, 2010 with English translation.

Notice of Grounds for Rejection for Japanese Application Serial No. 2006-346450, mailed Feb. 7, 2012, with English translation.

* cited by examiner

ELECTROLUMINESCENCE DISPLAY APPARATUS WITH VIDEO SIGNAL REWRITING

CROSS-REFERENCE TO RELATED APPLICATIONS

The entire disclosure of Japanese Patent Application No. 2006-346450 including specification, claims, drawings, and abstract is incorporated herein by reference.

BACKGROUND OF THE INVENTION

1. Field of the Invention

The present invention relates to a display apparatus having an electroluminescence element in each pixel, and particularly to correction of a display variation in such a display apparatus.

2. Description of the Related Art

Electroluminescence (hereinafter referred to as "EL") display apparatuses in which an EL element which is a self-emissive element is employed as a display element in each pixel are expected as a flat display apparatus of the next generation, and are being researched and developed.

After an EL panel is created in which an EL element and a thin film transistor (hereinafter referred to as "TFT") or the like for driving the EL element for each pixel are formed on a substrate such as glass and plastic, the EL display apparatus is subjected to several inspections and is then shipped as a product.

In a current active matrix EL display apparatus having a TFT in each pixel, a brightness unevenness occurs among the EL elements because of display unevenness caused by the TFT, in particular, a variation in the threshold value Vth of the TFT, which is a major cause of reduction in yield. An improvement in the yield of the products is very important, and, thus, reduction in the display defect and display unevenness (display variation) by improving an element design, a material, a manufacturing method, or the like is desired. Attempts have been made, for example, as described in JPA 2005-316408 (hereinafter referred to as "Reference Document 1"), in which, when a display unevenness or the like occurs, the display unevenness is corrected so that the panel is made a non-defective panel.

In the Reference Document 1, the EL panel is caused to emit light, variation in brightness of the pixels is measured, and a data signal (video signal) to be supplied to each pixel is corrected. In addition, as another method, a method is proposed in which a circuit which corrects the variation of Vth of an element driving transistor which controls a current to be supplied to the EL element is provided in each pixel.

The method of measuring the brightness variation by causing the EL panel to emit light and capturing an image of the emission with a camera as described in Reference Document 1 cannot be conducted after shipment, such that this method does not enable execution of corrections with respect to changes of the panel over time or the like. Furthermore, when are solution of the EL panel is increased and a number of pixels in the EL panel is increased, a number of the measurement and correction target becomes large for measuring the brightness variation for each pixel, and, thus, an increase in the resolution of the camera, an increase in capacity of a storage of correction information, etc. are required.

Moreover, even when the circuit element for compensating Vth is not to be incorporated, it is highly desired to correct the display unevenness caused by the variation in Vth of TFTs. In particular, it is desired to constantly perform this type of correction.

SUMMARY OF THE INVENTION

An advantage of the present invention is that, at a point after shipment, a display variation is accurately and efficiently measured for an EL display apparatus in real time and the display variation can be corrected.

According to one aspect of the present invention, there is provided an electroluminescence display apparatus comprising a display section having a plurality of pixels arranged in a matrix, a variation detecting section which detects an inspection result of a display variation in each pixel, and a correcting section which corrects the display variation. Each of the plurality of pixels in the display section comprises an electroluminescence element having a diode structure, and an element driving transistor which is connected to the electroluminescence element and controls a current that flows through the electroluminescence element. The variation detecting section comprises an inspection signal generator which generates an inspection signal to be supplied to a pixel in a row to be inspected and supplies the inspection signal to the pixel in the inspected row at a predetermined timing during execution of a display in accordance with a video signal, a current detector which detects a current that flows through the electroluminescence element in response to the inspection signal, and a memory section which stores a data corresponding to the current detected by the current detector. The memory section includes a volatile primary memory which stores the data corresponding to the current supplied from the current detector, anon-volatile secondary memory which stores and maintains therein the data stored in the primary memory during when an apparatus power supply is turned off, and a selector which selectively supplies the data stored in the secondary memory to the primary memory when the apparatus power supply is turned on. The correcting section executes a correction with respect to the video signal for each pixel in accordance with the data read out from the primary memory of the memory section.

According to another aspect of the present invention, in the above-described electroluminescence display apparatus, the correcting section executes the correction with respect to the video signal for each pixel using a correction data corresponding to a characteristic variation amount of the element driving transistor created by a correction data creating section based on the data read out from the primary memory.

According to a further aspect of the present invention, in the above-described electroluminescence display apparatus, the data corresponding to the current supplied from the current detector to the memory section is a correction data created by a correction data creating section based on the current detected by the current detector and in accordance with a characteristic variation amount of the element driving transistor.

According to a still further aspect of the present invention, in the above-described electroluminescence display apparatus, the inspection signal generator supplies to the pixel in the inspected row during a blanking period, as the inspection signal, an inspection ON signal and also an inspection OFF signal that sets the electroluminescence element to a non-emission level. A current detection amplifier detects an ON current obtained during application of the inspection ON signal and an OFF current obtained during application of the inspection OFF signal. The memory section stores a data corresponding to a current difference between the detected ON current and OFF current.

According to another aspect of the present invention, in the above-described electroluminescence display apparatus, a data save controller in the memory section operates to save the data stored in the primary memory into the secondary memory at a predetermined timing.

According to a further aspect of the present invention, in the above-described electroluminescence display apparatus, the blanking period is a horizontal blanking period, and, during a predetermined horizontal blanking period, the current difference between the ON current and the OFF current is detected sequentially for the pixels in the inspected row and is sequentially stored in the memory section.

According to a still further aspect of the present invention, in the above-described electroluminescence display apparatus, the blanking period is a vertical blanking period, and, during the vertical blanking period, the current difference between the ON current and the OFF current is detected sequentially for the pixels in the inspected row and is sequentially stored in the memory section.

According to an aspect of the present invention, there is provided an electroluminescence display panel driving apparatus comprising a variation detecting section which detects an inspection result of a display variation in each pixel of an electroluminescence display panel provided with a display section having a plurality of pixels arranged in a matrix, each of the plurality of pixels including an electroluminescence element having a diode structure and an element driving transistor which is connected to the electroluminescence element and controls a current that flows through the electroluminescence element. The driving apparatus further comprises a correcting section which corrects the display variation. The variation detecting section comprises an inspection signal generator which generates an inspection signal to be supplied to a pixel in a row to be inspected and supplies the inspection signal to the pixel in the inspected row at a predetermined timing during execution of a display in accordance with a video signal, a current detector which detects a current that flows through the electroluminescence element in response to the inspection signal, a volatile primary memory which stores a data corresponding to the current supplied from the current detector, and a selector which selectively supplies to the primary memory a data read out from a non-volatile secondary memory which stores and maintains therein the data stored in the primary memory during when an apparatus power supply is turned off. The correcting section executes a correction with respect to the video signal for each pixel in accordance with the data read out from the primary memory of a memory section.

According to another aspect of the present invention, in the above-described apparatuses, the current that flows through the electroluminescence element is a cathode current.

According to various aspects of the present invention, an inspection signal is supplied to pixels in an inspected row at a predetermined timing during execution of a display in accordance with a video signal, a current such as a cathode current or an anode current that flows through an EL element at that time is detected, the detected current detection data is stored in a memory section, and a correcting section executes a correction in accordance with the data read out from the memory section. The memory section is composed using a volatile primary memory and a non-volatile secondary memory, and the current detection data stored in the primary memory is saved into the secondary memory at every predetermined timing. With this arrangement, while the stored data in the primary memory becomes erased when the apparatus power supply is turned off, the current detection data stored in the secondary memory can be used to execute correction when the apparatus power supply is turned on. As such, variations between the pixels can be corrected to thereby execute a high-quality display from immediately after turning on the power supply.

For example, by executing the current detection during the horizontal blanking period or the vertical blanking period of the video signal, it is possible to detect variations between the pixels and perform the correction while carrying out a normal display. Further, even though some time may be required after turning on the power until the measured current detection data become available regarding all the pixels, the correction can be executed using the current detection data stored in advance in the secondary memory until new data are obtained, such that it is possible to prevent display unevenness due to characteristic variation of the pixels to be observed even at the time of turning on the power.

Moreover, because the current detection and the data correction are constantly executed, even when display variation (display unevenness) occurs at a point after shipment of the display apparatus, such variation can be corrected in real time.

Furthermore, because the measurement target is the current that flows through the EL element instead of the emission brightness, the measurement can be made with a simple structure. In addition, by switching the EL element ON and OFF and measuring the ON and OFF current values, it is possible to accurately know the ON current with the OFF current as a reference, which facilitates accurate and rapid measurement and correction processes.

BRIEF DESCRIPTION OF THE DRAWINGS

A preferred embodiment of the present invention will be described in detail by reference to the drawings, wherein.

DESCRIPTION OF THE PREFERRED EMBODIMENT

A preferred embodiment of the present invention (hereinafter referred to as "embodiment") will now be described with reference to the drawings.

[Detection Principle]

Figure 1:
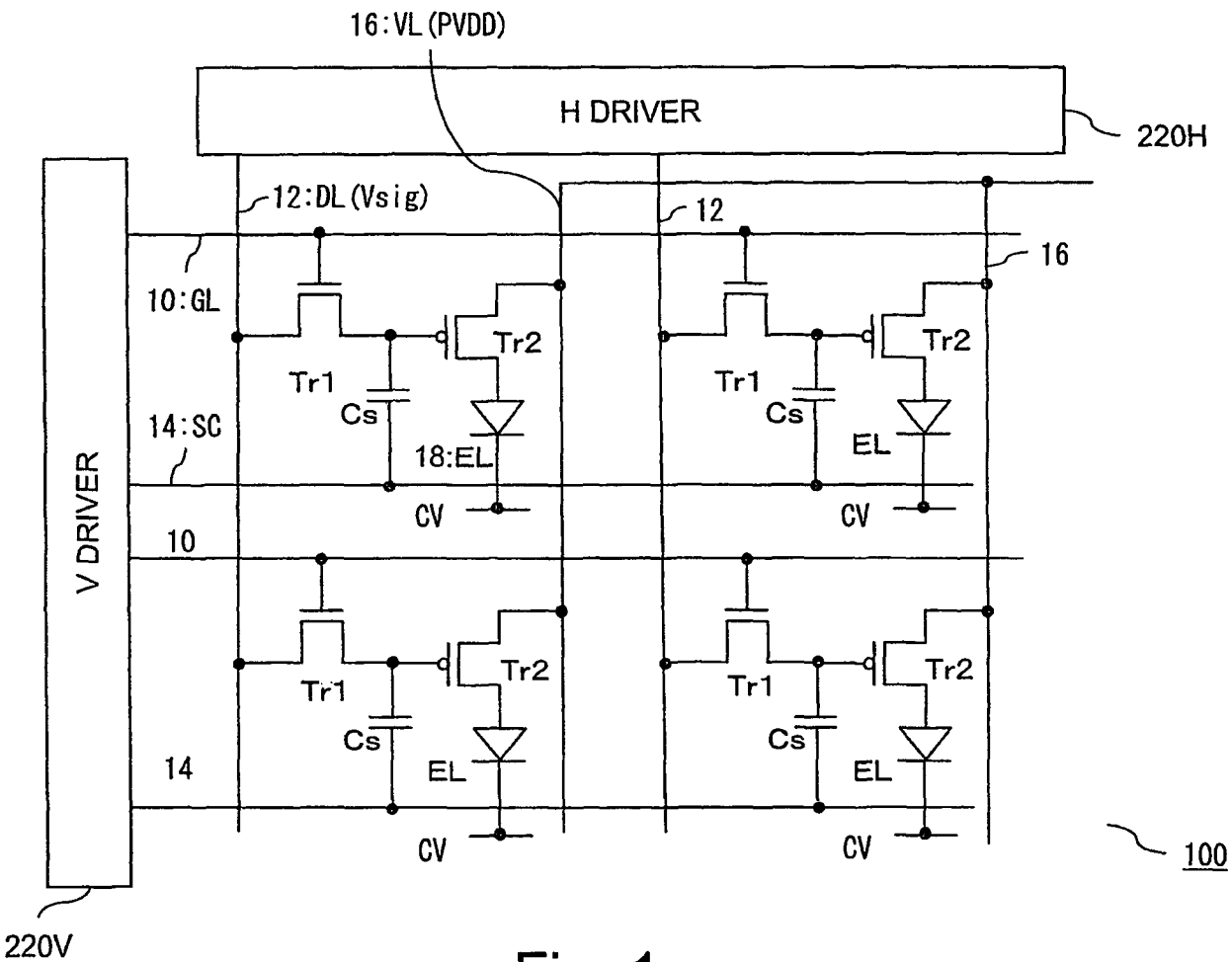
FIG. 1 is an equivalent circuit diagram for explaining an example schematic circuit structure of an EL display apparatus according to a preferred embodiment of the present invention.

In the embodiment, a display apparatus is an active matrix organic electroluminescence (EL) display apparatus, and a display section having a plurality of pixels is formed on an EL panel 100. FIG. 1 is a diagram showing an example equivalent circuit structure of an active matrix EL display apparatus according to the embodiment. A plurality of pixels are arranged in the display section of the EL panel 100 in a matrix form, a selection line (gate line GL) 10 on which a selection signal is sequentially output is formed along a horizontal (H) scan direction (row direction) of the matrix, and a data line 12 (DL) on which a data signal (Vsig) is output and a power supply line 16 (VL) for supplying a drive power supply PVDD to an organic EL element 18 (hereinafter simply referred to as "EL element") which is an element to be driven are formed along a vertical (V) scan direction (column direction).

Each pixel is provided in a region approximately defined by these lines. Each pixel comprises an EL element 18 as an element to be driven, a selection transistor Tr1 formed by an n-channel TFT (hereinafter referred to as "selection Tr1"), a storage capacitor Cs, and an element driving transistor Tr2 formed by a p-channel TFT (hereinafter referred to as "element driving Tr2").

The selection Tr1 has a drain connected to the data line 12 which supplies a data voltage (Vsig) to the pixels along the vertical scan direction, a gate connected to the gate line 10 which selects pixels along a horizontal scan line, and a source connected to a gate of the element driving Tr2.

A source of the element driving Tr2 is connected to the power supply line 16 and a drain of the element driving Tr2 is connected to an anode of the EL element. A cathode of the EL element is formed common for the pixels and is connected to a cathode power supply Cv.

The EL element 18 has a diode structure and comprises a light emitting element layer between a lower electrode and an upper electrode. The light emitting element layer comprises, for example, at least a light emitting layer having an organic light emitting material, and a single layer structure or a multilayer structure of 2, 3, or 4 or more layers can be employed for the light emitting element layer depending on characteristics of the materials to be used in the light emitting element layer or the like. In the present embodiment, the lower electrode is patterned into an individual shape for each pixel, functions as the anode, and is connected to the element driving Tr2. The upper electrode is common to a plurality of pixels and functions as the cathode.

In an active matrix EL display apparatus having the circuit structure as described above in each pixel, if an operation threshold value Vth of the element driving Tr2 varies, even when a same data signal is supplied to the pixels, the same current is not supplied from the drive power supply PVDD to the EL element, which causes brightness variation (display variation).

Figures 2A, 2B:
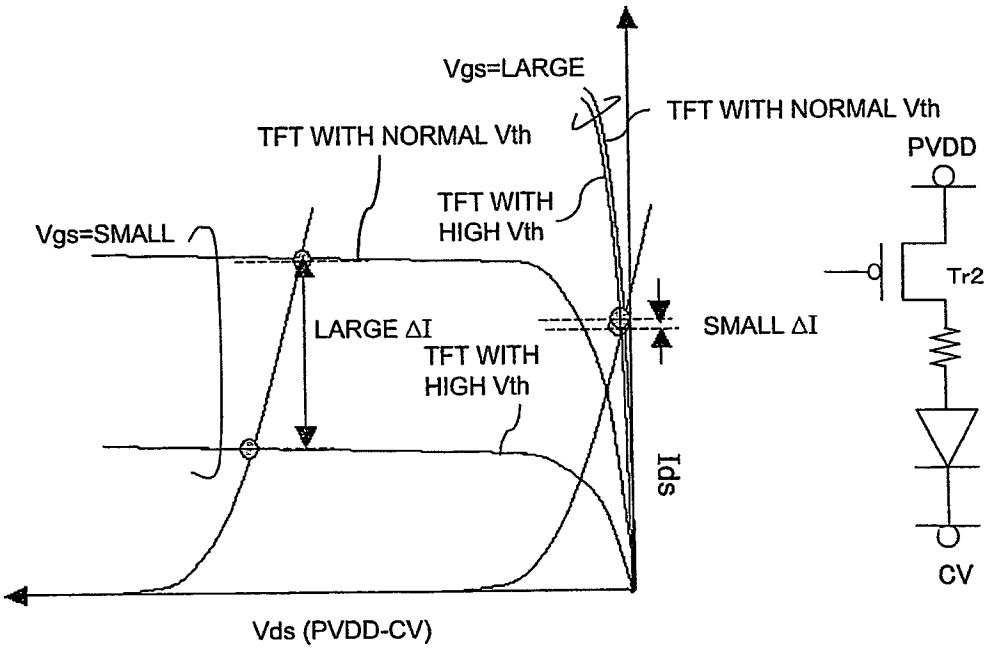
FIGS. 2A and 2B are diagrams for explaining a principle of measurement of a characteristic variation of an element driving transistor according to a preferred embodiment of the present invention.

FIGS. 2A and 2B show an equivalent circuit of a pixel and Vds-Ids characteristics of the element driving Tr2 and the EL element when a characteristic variation (variation in a current supplying characteristic; for example, variation in the operation threshold value Vth) occurs in the element driving Tr2. When the operation threshold value Vth of the element driving Tr2 varies, the circuit can be considered as having a resistance which is larger or smaller than that in the normal case is connected to a drain side of the element driving Tr2 as shown in FIG. 2B. Therefore, although the characteristic of the current (in the present embodiment, cathode current Icv) flowing through the EL element is not different from that of the normal pixel, the current actually flowing through the EL element would vary according to a characteristic variation of the element driving Tr2.

When a voltage applied to the element driving Tr2 satisfies a condition of $Vgs-Vth<Vds$, the element driving Tr2 operates in a saturation region. In a pixel having the operation threshold value Vth of the element driving Tr2 which is higher than that for a normal pixel, the current Ids between the drain and the source of the transistor is smaller than that for a normal transistor and an amount of supplied current to the EL element, that is, the current flowing through the EL element is smaller than that for a normal pixel (a large $\Delta I$), as shown in FIG. 2A. As a result, the emission brightness of the pixel is reduced compared to the emission brightness of the normal pixel and a display variation occurs.

On the other hand, in a pixel having an operation threshold value Vth of the element driving Tr2 which is smaller compared to that of the normal pixel, the current Ids between the drain and the source of the transistor is larger than that of a normal transistor, the current flowing through the EL element is larger than that of the normal pixel, and the emission brightness is higher.

When a voltage applied to the element driving Tr2 satisfies a condition of $Vgs-Vth>Vds$, the element driving Tr2 operates in a linear region. In the linear region, a difference in the Ids-Vds characteristic between an element driving Tr2 having a higher threshold value Vth and an element driving Tr2 having a lower threshold value Vth is small, and, thus, a difference in the amount of supplied current to the EL element ($\Delta I$) is also small. Because of this, the EL elements show similar emission brightness regardless of the presence or absence of the characteristic variation in the element driving Tr2, and, thus, it is difficult to detect a display variation caused by the characteristic variation in the linear region. By operating the element driving Tr2 in the saturation region as described above, it is possible to detect the display variation caused by the characteristic variation in the element driving Tr2.

The display variation can be reliably corrected by correcting the data signal to be supplied to each pixel based on the detected current value. For example, when the threshold value $|Vth|$ of the element driving Tr2 is smaller than that of a normal pixel, the emission brightness of the EL element when a reference data signal is supplied is higher than that of the normal pixel. Therefore, in this case, the brightness variation can be corrected by reducing the absolute value |Vsig| of the data signal according to a shift of the threshold value |Vth| with respect to the reference. When, on the other hand, the threshold value |Vth| of the element driving Tr2 is higher than that of a normal pixel, the brightness variation can be corrected by increasing the absolute value |Vsig| of the data signal according to the shift of the threshold value |Vth| with respect to the reference.

In the above-described circuit structure, a p-channel TFT is employed as the element driving transistor. However, the present invention is not limited to such a configuration, and, alternatively, an n-channel TFT may be used. In addition, although in the above-described pixel circuit, an example structure is described in which two transistors including a selection transistor and a driving transistor are employed as transistors in a pixel, the present invention is not limited to a structure with two transistors or to the above-described circuit structure.

According to the present embodiment, as described above, brightness variation of an EL element caused by characteristic variation of an element driving Tr in each pixel is detected from the cathode current of the EL element, and the detected brightness variation is corrected. These current detection (variation detection) and correction are executed during normal operation of the display apparatus within one blanking period of a video signal.

Further, according to the present embodiment, while the detected cathode current detection data is stored in a primary memory which is capable of high-speed operation, the data in the primary memory is saved in advance into a non-volatile secondary memory. With this arrangement, even when the apparatus power supply is turned off and the detection data within the primary memory becomes erased, upon turning on the power supply again, the detection data stored in the non-volatile secondary memory can be read out and used for performing correction from immediately after turning on the power supply.

The cathode current detection processing is performed within one blanking period of a video signal by selecting one certain row of a display section as the inspected row, supplying an inspection signal to a corresponding pixel, and detecting the cathode current Icy flowing from the cathode electrode of the EL element to the cathode terminal within the pixel. The blanking period is either a vertical blanking period or a horizontal blanking period. As the driving scheme, the schemes outlined below may be employed. Further details of the driving schemes are described later.

(Driving Scheme 1) A Case in which the Cathode Electrode is the Common Electrode Shared by all the Pixels, and Cathode Current Detection is Performed During a Horizontal Blanking Period With respect to an EL panel 100 composed of a matrix including y rows and x columns, within one horizontal blanking period, certain one inspected row (nth row) is selected, an inspection signal is supplied to a pixel in a certain column (kth column), and the cathode current obtained at that time is detected. By sequentially repeating this process while changing the selected row, cathode current detection can be carried out for all the pixels in the kth column during one frame (one vertical (V) scan) period. By performing this process for all columns, the detection processing can be completed for all the pixels in the EL panel 100. When the EL panel has a VGA size, there exist 480 rows×640 columns of pixels. Using the above-described method in such a panel, assuming 60 Hz for one frame, cathode current detection for all pixels can be executed in a total of approximately 10.7 seconds (=1/60 seconds×640 columns).

(Driving Scheme 2) A Case in which the Cathode Electrode is the Common Electrode for all the Pixels, and Cathode Current Detection is Performed During a Vertical Blanking Period Within one vertical blanking period, an inspection signal is sequentially supplied to all the pixels in certain one inspected row (nth row), and the cathode current obtained at that time is detected. By performing this process in every vertical blanking period while changing the selected row to execute the process with respect to all rows, the cathode current is obtained for each of all the pixels in the panel. Using this method in a VGA panel similarly to the above, cathode current detection for all pixels can be executed in a total of approximately 8 seconds (=1/60 seconds×480 rows).

(Driving Scheme 3) A Case in which the Cathode Electrode is Divided Corresponding to Each Column, and Cathode Current Detection is Performed During a Vertical Blanking Period Within one vertical blanking period, an inspection signal is supplied to respective ones of all the pixels in certain one inspected row (nth row), and the cathode current for each column is detected. By performing this process in every vertical blanking period while changing the selected row to execute the process with respect to all rows, the cathode current is obtained for all the pixels in the panel. Using this method in a VGA panel similarly to the above, cathode current detection for all pixels can be executed in a total of approximately 8 seconds (=1/60 seconds×480 rows).

When the driving capability (driving speed) of the driver section is sufficiently high, it is possible to supply the inspection signal to all pixels belonging in one certain row and detect the current from the cathode electrode in each column during a horizontal blanking period. In this case, the cathode current can be measured for all pixels in the panel within one frame period.

[Example Apparatus Configuration]

Figure 3:
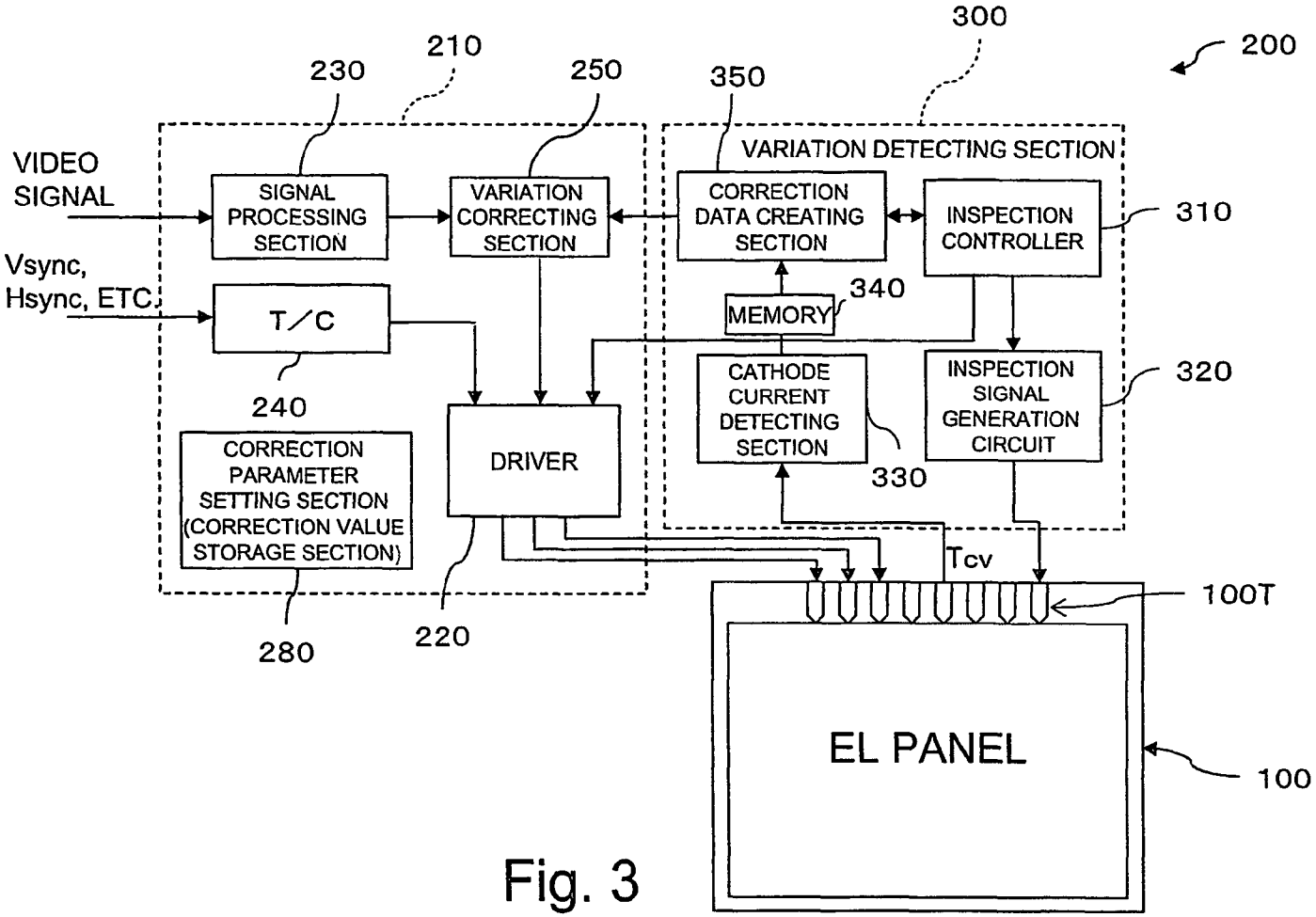
FIG. 3 is a diagram showing an example configuration of an EL display apparatus provided with the display variation correction function according to a preferred embodiment of the present invention.
Figure 4:
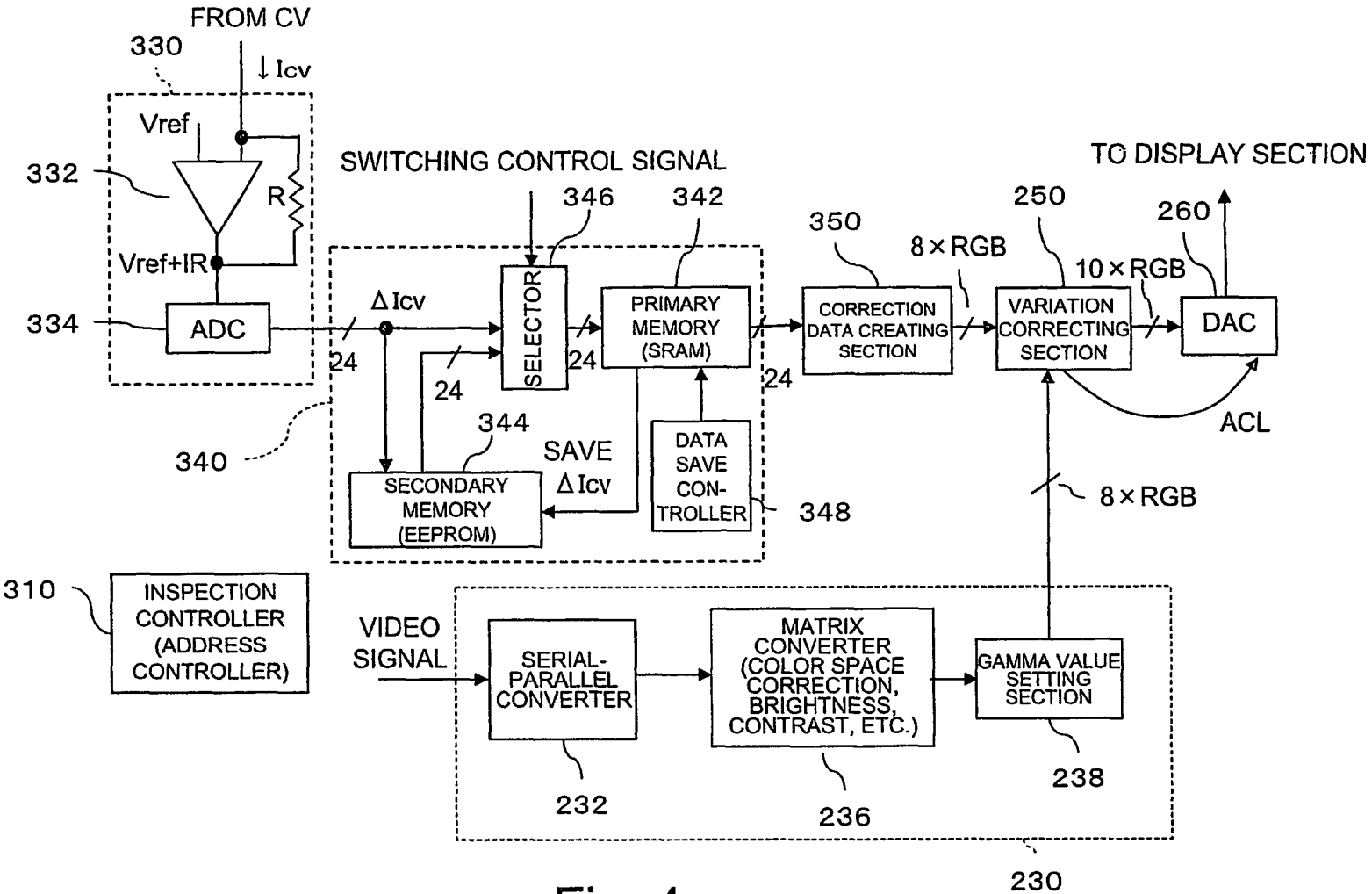
FIG. 4 is a diagram showing a part of a more specific configuration of the driving section of FIG. 3.

An example structure of an electroluminescence display apparatus having a variation correction function according to an embodiment of the present invention is next described referring to FIGS. 3 and 4. FIG. 3 shows one example of an overall configuration of an electroluminescence display apparatus. This display apparatus comprises an EL panel 100 provided with a display section having pixels as described above, and a driving section 200 that controls display and operation in the display section. The driving section 200 schematically comprises a display controller 210 and a variation detecting section 300.

The display controller 210 includes a signal processor 230, a variation correcting section 250, a timing signal creating (T/C: Timing controller) section 240, a driver 220, and the like.

The signal processor 230 generates a display data signal suitable for displaying on the EL panel 100 based on a color video signal provided from outside. The timing signal creating section 240 generates, based on a dot clock signal (DOTCLOCK), synchronization signals (Hsync, Vsync), and the like, various timing signals such as H-direction and V-direction clock signals CKH, CKV and horizontal and vertical start signals STH, STV, which are required in the display section. The variation correcting section 250 uses a correction data supplied from the variation detecting section 300 to correct a video signal in accordance with a characteristic of the EL panel which is the target to be driven.

The driver 220 generates, based on the various timing signals obtained from the timing signal creating section 240, signals for driving the EL panel 100 in the H direction and the V direction, and supplies the generated signals to the pixels. Further, the driver 220 also supplies a corrected video signal supplied from the variation correcting section 250 as a data signal (Vsig) to a corresponding pixel. As shown for example in FIG. 1, the driver 220 comprises an H driver 220H that controls drive of the display section in the H (row) direction and a V driver 220V that controls drive in the V (column) direction. As can be seen in FIG. 1, the H driver 220H and the V driver 220V may be integrated on the panel substrate together with the pixel circuit of FIG. 1 in a peripheral region around the display area of the EL panel 100. Alternatively, the H driver 220H and the V driver 220V may be composed as a separate unit from the EL panel 100 on an integrated circuit (IC) together with or separately from the driving section 200 of FIG. 3.

The variation detecting section 300 operates during a blanking period under a normal use environment of the EL panel 100 to detect a display variation and obtain a correction value. In the example of FIG. 3, the variation detecting section 300 comprises an inspection controller 310 that controls variation inspection, an inspection signal generation circuit 320 that generates an inspection signal and supplies the generated signal to a pixel in an inspected row of the EL panel, a cathode current detector 330 that detects a cathode current obtained from a cathode electrode when the inspection signal is supplied, a memory 340 that stores a cathode current detection result, a correction data creating section 350 that creates a correction data based on the detected cathode current, and the like. Further, a control signal generation circuit for generating a selection signal necessary for selecting and inspecting a pixel of an inspected row when performing the inspection and a control signal for performing electric potential control of a predetermined line as described below may be integrated within the driver 220 and may be caused to operate in response to control by the detection controller 310. This structure may be executed as a control signal generation circuit provided exclusively for inspection, or may alternatively be executed by the inspection controller 310.

FIG. 4 shows a part of a more specific configuration of the driving section 200 of FIG. 3. The cathode current detector 330 includes a current detection amplifier 332 and an analog-digital (AD) converter 334. In the example shown in FIG. 4, the current detection amplifier 332 includes a resistor R provided between the amplifier output side and the current input side. The cathode current Icv obtained from the cathode electrode terminal Tcv of the EL panel is acquired as a current detection data (voltage data) expressed by [Vref+IR] based on voltage [IR] generated when the cathode current Icv flows in the resistor R and the reference voltage Vref. The AD converter 334 converts the current detection data acquired in the current detection amplifier 332 into a digital signal having a predetermined number of bits.

This detection data is supplied to the memory 340 and stored therein. It is noted that, although the above-mentioned AD converter 334 is not a mandatory component for detecting the cathode current, by having the detection data converted into a digital signal in the memory 340, it becomes possible to speedily execute the writing of the detection data into the memory 340 and the creation of correction data using this detection data.

By supplying as the inspection signal an inspection ON display signal which sets the EL element to an emission level, in principle it is possible to detect a display unevenness in accordance with a variation in the threshold value of the element driving Tr2. However, as explained further below, increased inspection speed and accuracy can be achieved by supplying, as the inspection signal to a pixel in the inspected row, the inspection ON display signal and also an inspection OFF display signal which sets the EL element to a non-emission level, detecting an ON cathode current obtained during application of the inspection ON display signal and an OFF cathode current obtained during application, of the inspection OFF display signal, and obtaining the difference ΔIcv. Inspection speed and accuracy can be increased in this manner because the OFF cathode current $Icv_{off}$ is measured, and the ON cathode current $Icv_{on}$ during application of the ON display signal is determined relatively using this $Icv_{off}$ as a reference. This eliminates the necessity to accurately determine the absolute value of the ON cathode current $Icv_{on}$ or to separately measure an OFF cathode current $Icv_{off}$ for use as a reference. In other words, by using the difference between the ON cathode current and the OFF cathode current (the cathode current difference), any influences of characteristic variation of the current detection amplifier 332 or the like can be canceled from the cathode current difference, and no reference value for determining the absolute value of the ON cathode current is necessary. More specifically, $Vref+Icv_{on}*R$ and $Vref+Icv_{off}*R$ are respectively acquired and digitally converted in the AD converter 334. A subtraction between the two data is performed in a subtractor before supplying to the memory section 340, to finally obtain $(Icv_{on}-Icv_{off})*R$, such that $\Delta Icv=Icv_{on}-Icv_{off}$ can be obtained.

As explained in the above-noted (Driving Schemes 1)-(Driving Scheme 3), the cathode current detection data regarding all pixels are accumulated in the memory 340 in approximately 10 seconds, for example. The memory 340 stores these cathode current detection data for all pixels at least until new cathode current detection data for all pixels are subsequently obtained.

The memory 340 includes a volatile primary memory 342 and a non-volatile secondary memory 344. The memory 340 further includes a selector 346 which selects, as data to be supplied to the primary memory 342 (ΔIcv data), either of the data obtained in real time from the current detector 330 or the stored data in the secondary memory 344.

As the primary memory 342, a volatile memory capable of performing data writing and readout at a high speed (such as an SRAM) is employed. On the other hand, a non-volatile memory such as an EEPROM which is capable of retaining data when the apparatus power supply is turned off and which is rewritable is employed as the secondary memory 344. When the drive circuit 200 is to be formed into a single integrated circuit, the primary memory 342 and the selector 346 can be formed on the same integrated circuit. While it is also possible to form the secondary memory 344 on the same integrated circuit, the secondary memory 344 may be configured using an integrated circuit that is independent and separate from the above-noted integrated circuit.

By employing a high-speed memory as the primary memory 342, it is possible to store the cathode current detection data and to supply the detection data to the correction data creating section 350 at a high speed. However, a high-speed memory such as an SRAM is volatile, such that data becomes erased when the apparatus power supply is turned off. Meanwhile, when the cathode current detection is executed during a horizontal or vertical blanking period, approximately 8 to 10 seconds are required for obtaining the cathode current detection results regarding all pixels according to the above-noted example driving schemes. Accordingly, during several tens of seconds from the point of turning on power, the cathode current detection data required for creating the correction data would not be present in the primary memory 342, such that it would not be possible to perform the correction. In order to avoid such a situation, according to the present embodiment, a non-volatile EEPROM or the like is provided as the secondary memory 344, and, by means of control by the selector 346, the cathode current detection data regarding all pixels stored in advance in this secondary memory 344 are read out and supplied to the primary memory 342 when the power is turned on. With this arrangement, during the period from immediately after turning on power until all the cathode current detection data measured in real time become available, the correction can be performed using the cathode current detection data stored in the secondary memory 344.

At the time of turning on power, the selector 346 selects the output from the secondary memory 344 as data to be supplied to the primary memory 342. After once writing the data of the secondary memory 344 into the primary memory 342, the selector 346 selects the data supplied in real time from the cathode current detector 330. This switching control of the selector 346 may be carried out for example using a switching control signal from a device controller (CPU) not shown, or may be executed by the inspection controller 310.

Into the secondary memory 344, the cathode current detection data stored in the primary memory 342 can be written at a point after receiving an instruction to turn off the apparatus power supply and before the power supply is actually turned off. At the time of shipping of the panel 100 from the factory, initial values of the cathode current detection data measured in advance regarding each pixel may be directly written into the secondary memory 344 before shipment. Alternatively, it is possible to place the display apparatus in normal operation before shipment, and to transfer the cathode current detection data stored thereby in the primary memory 342 into the secondary memory 344.

Although a non-volatile memory such as an EEPROM is not capable performing high-speed operation as fast as an SRAM, the non-volatile memory has a sufficiently high operation speed for performing an exchange of cathode current detection data with the primary memory 342 at the time of turning on power before the power is turned on. Accordingly, by employing such an on-volatile memory as the secondary memory 344, it is possible to always perform a display using data subjected to a correction regarding two-dimensional display variation based on the cathode current detection.

Reliability can be ensured by executing the processing of saving the cathode current detection data from the primary memory 342 into the non-volatile secondary memory 344 at every time the apparatus power supply is turned off. However, when there exists a limit to the number of times the secondary memory 344 can be rewritten (for example, a currently available EEPROM is limited to approximately 100,000 times), considering the device life, it is preferable to perform the saving processing under control of the data save controller 348 using a timer or the like so as to write the data stored in the primary memory 342 into the secondary memory 344 at intervals such as every day, every several days, or every instance a predetermined number of times of turning off power is performed. It should be noted that, even when the writing is not performed every time the power is turned off, the output of the current detection data to the primary memory 342 is executed every time the power is turned on.

In FIG. 4, the detection data (ΔIcv in this example) from the cathode current detector 330 is supplied to both the selector 346 and the secondary memory 344. After shipment from the factory, it is not particularly necessary to directly supply the detection data from the cathode current detector 330 to the secondary memory 344, such that this path for supplying the detection data may be omitted. It is possible to use this path before shipment from the factory when directly writing ΔIcv into the secondary memory 344 or the like.

The correction data creating section 350 occasionally reads out the cathode current detection data for each pixel accumulated in the primary memory 342 within the memory 340, and, based on this data, creates a correction data for correcting a display variation caused by a characteristic variation of the element driving Tr2 in each pixel, as described below. Because it is necessary to obtain a correction data for each one of the pixels, it is required that the readout of the cathode current detection data from the primary memory 342 be performed for each of the individual pixels, and that the readout be performed at a high speed. As an SRAM or the like which is volatile but has a high response speed is employed as the primary memory 342, these requirements can be sufficiently satisfied.

Figure 5:
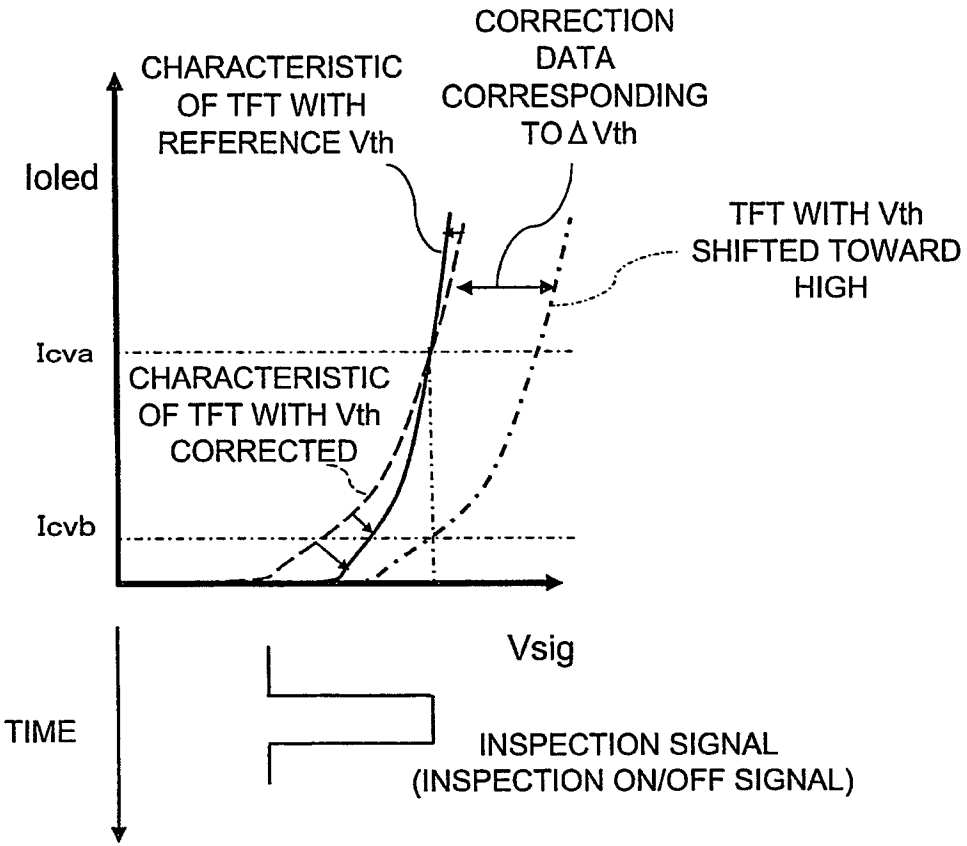
FIG. 5 is a diagram for explaining a shift in an operation threshold value of an element driving transistor Tr2 and a method for correcting the shift.

Next, the creation of a correction data corresponding to a shift in the threshold value of the element drive Tr2 is explained. As shown in FIG. 5, upon application of an identical inspection signal which sets an EL element to an emission state, when the element driving Tr2 of the measured pixel has a threshold value Vth that is shifted toward a higher voltage side than the threshold value Vth of a normal element driving Tr2 (as shown by a dot-dash line in FIG. 5), the cathode current obtained in the shifted pixel becomes Icvb, whereas the cathode current in a normal pixel is Icva.

Accordingly, when the operation threshold value Vth of the element driving Tr2 is shifted (i.e., deviated) from that of a normal TFT as shown in FIG. 5, the correction data creating section 350 obtains, from the cathode current detection data, a correction data for compensating the deviation of the operation threshold value Vth. Conceptually, based on this correction data, the voltage of the data signal supplied to each pixel is caused to be shifted in accordance with the amount of deviation in the operation threshold value Vth, so as to attain the characteristic state shown by a dashed line in FIG. 5.

One example method of creating a correction data for shifting a voltage of a data signal is specifically described as follows. First, a deviation of the operation threshold value of each pixel from a reference may be calculated using equation (1) below.

$$(V\Delta Icv) = V(\Delta Icvref) \times \left(\frac{Vsigon - Vth(i)}{Vsigon}\right)^{\gamma} \quad (1)$$

In equation (1), Vth(i), V(Icv), Vsigon, and γ are defined as below.

Vth(i): Deviation of the operation threshold value of the inspected pixel.

V(ΔIcv): ON-OFF cathode current value of the inspected pixel (voltage data).

V(ΔIcvref): Reference ON-OFF cathode current value (voltage data).

Vsigon: Tone level of the inspection ON display signal.

γ: Emission efficiency characteristic of the display panel (constant value).

When, for example, the tone level [Vsigon] of the inspection ON display signal is set to 240 (in a range of 0-255), based on this tone level 240, the ON-OFF cathode current value of the inspected pixel [V(ΔIcv)], the reference ON-OFF cathode current value [V(ΔIcvref)], and the constant value of emission efficiency characteristic γ, it is possible to calculate using the above equation (1) the deviation Vth(i) of the operation threshold value of each pixel with respect to the reference. For example, it is assumed that, for pixels A though E, the following amounts of threshold value deviation Vth(i) from the reference are obtained:

$$Vth(A)=0$$

$$Vth(B)=13.4$$

$$Vth(C)=17.0$$

$$Vth(D)=3.2$$

$$Vth(E)=20.7$$

In this example, the deviation of the threshold value for pixel E is the highest. In this case, when data signals having an identical tone level are supplied to the respective pixels, pixel E emits at the lowest brightness in the display section. Meanwhile, there exists a limit regarding the maximum value of data signal that can be supplied to the pixels. Accordingly, using the $Vth(i)_{max}$ of pixel E as a reference, the maximum data signal value $Vsig_{max}$ is determined. In other words, the maximum value $Vth(i)_{max}$ is selected from among the Vth(i) values obtained for the respective pixels, and a difference ΔVth(i) of the Vth value for each of all other pixels with respect to the value Vth(i) max is obtained. Subsequently, the maximum value $Vsig_{max}$ (i) of data signal that should be supplied to each pixel is calculated by subtracting the obtained ΔVth(i) from $Vsig_{max}$ to determine [$Vsig_{max}$−ΔVth (i)]. Further, the calculated result is reflected in an initial correction data RSFT(init) shown in equation (2) explained further below, and is supplied to the variation correcting section 250.

A set of the correction data for the respective pixels created in the correction data creating section 350 as described above can be stored in a correction value storage section 280 shown in FIG. 3, for example. It is preferable to store these correction data until a next set of correction data for all pixels subsequently become available.

The variation correcting section 250 uses these stored correction data until new correction data are obtained, to execute variation correction for each pixel (two-dimensional display variation correction) with respect to a video signal supplied from the signal processor 230. The correction data creating section 350 may create the correction data and supply the created data to the variation correcting section 250 at timings necessary for performing correction computation in the variation correcting section 250 (i.e., at timings in accordance with the video signal). In that case, $Vsig_{max}$(i) alone is stored in the above-noted correction value storage section 280 or the like, and the correction data creating section 350 reads out from the primary memory 342 the cathode current detection data (digital data) regarding the required pixel address and uses the read-out data and $Vsig_{max}$(i) to create the correction data for supplying to the variation correcting section 250.

The signal processor 230 is a signal processing circuit which generates a display signal suitable for displaying on the EL panel 100 based on a color video signal provided from outside, and may for example have a configuration as shown in FIG. 4. A serial-parallel converter 232 converts an externally-supplied video signal into a parallel data, and the resulting parallel data is supplied to a matrix converter 236. In the matrix converter 236, when the externally-supplied video signal has YUV format, an offset processing in accordance with the color tone displayed on the EL panel is carried out. Y is a luminance signal, U denotes a difference between the luminance signal and a blue component, and V denotes a difference between the luminance signal and a red component. In YUV format, these three information items are used to express colors. Further, the matrix converter 236 performs converting processing such as data reduction (thinning) of the parallel video signal into a format suitable for the EL panel 100. The matrix converter 236 also executes color space correction, brightness and contrast correction, and the like. Subsequently, a gamma value setting section 238 performs setting of a y value in accordance with the EL panel 100 (gamma correction) with respect to the video signal supplied from the matrix converter 236. The gamma-corrected video signal is supplied to the above-noted variation correcting section 250.

In one example, the variation correcting section 250 uses equation (2) below to execute the two-dimensional display variation correction.

$$\text{R_SFT}(0) = \frac{\frac{\text{ADJ_SFT}}{16} \times (512 - Rin) + Rin}{512} \times RSFT(init) \tag{2}$$

In equation (2), RSFT(init) denotes an initial correction data which reflects the correction value obtained in the correction data creating section 350 (when there exists a correction data for each pixel before shipment from the factory, that correction data is also reflected). Rin denotes an input video signal supplied from the signal processor 230, and, in this example, is a 9-bit data having any value from among 0-511. ADJ_SFT denotes a correction value adjusting (weighting) parameter, and R_SFT denotes a display data after being subjected to the two-dimensional display variation correction.

Figure 6:
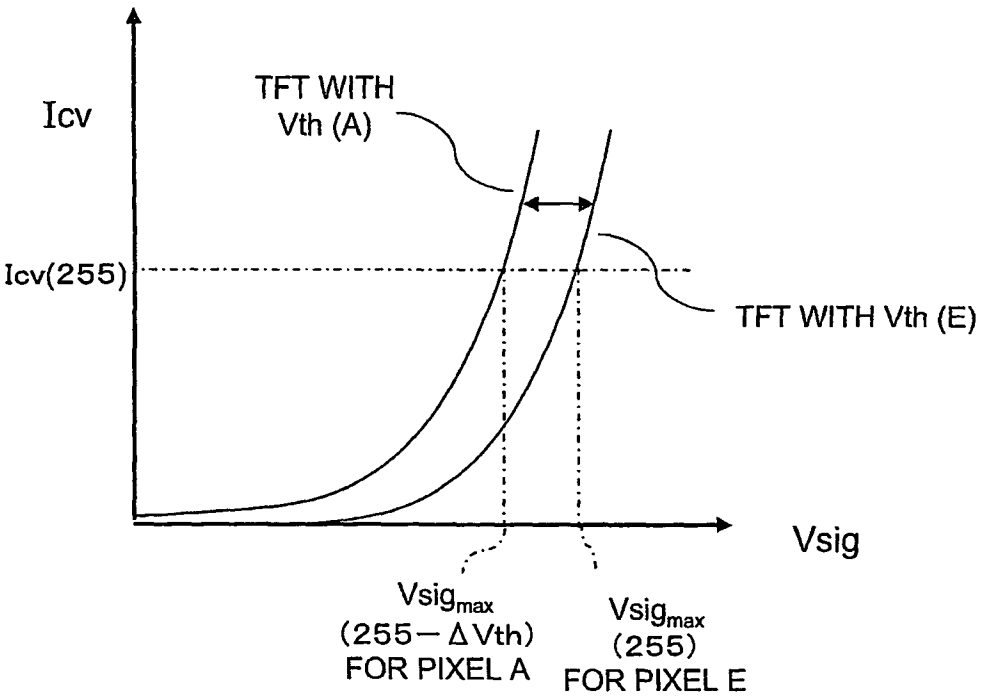
FIG. 6 is a diagram for explaining a method for obtaining a correction data corresponding to a shift in the operation threshold value.

As can be understood from FIG. 5, when a deviation occurs in the operation threshold value Vth of the element driving Tr2, the slope β of the characteristic curve of this TFT differs from the slope β of the characteristic curve of a normal TFT. As such, by simply shifting the data signal by the amount of deviation of Vth as shown in FIG. 6, accurate tone expression cannot be achieved. Accordingly, the variation correcting section 250 employs the above equation (2) or the like to take into account the slope β (i.e., the weighting parameter in the above equation (2)), so as to execute an optimal correction in accordance with the actual video signal value (luminance level), thereby accomplishing an adjustment such that a cathode current that results in a characteristic corresponding to a normal TFT characteristic flows through the EL element. With this correction, it is possible to reliably prevent a problem such as whitish display on the lower tone level side (deviation toward the higher tone level side) caused by a difference in the slope of the TFT characteristic when the correction is executed simply by a shift by ΔVth.

The video signal after being subjected to the two-dimensional display variation correction as described above is supplied to a digital-analog (DA) converter 260, and is converted into an analog data signal to be supplied to each pixel. This analog data signal, which is data that should be output to a corresponding data line 12 of the display section, is output to a video line provided in the panel 100, and is supplied to the corresponding data line 12 in accordance with control by the V driver 220V. Here, it should be noted that the variation correcting section 250 estimates power consumption from the data signal supplied from the signal processor 230, generates an ACL signal for performing optimal control of the peak current of the EL panel 100, and supplies the ACL signal to the DA converter 260. With this arrangement, occurrence of an excessive current consumption in the panel 100 is prevented.

As shown in FIG. 4, the cathode current detection data output from the analog-digital converter 334 is composed of 8 bits for each of R, G, and B (i.e., a total of 24 bits), and the memory section 340 and the correction data creating section 350 also handle 8-bit data for each of R, G, and B. In the variation correcting section 250, the R, G, and B video signals sequentially supplied from the signal processing circuit 230 are composed of 8 bits respectively. The variation correcting section 250 employs the 8-bit video signal and the 8-bit correction data to generate therein the display data after being subjected to the two-dimensional display variation correction which is composed of 10 bits for each of R, G, and B. In this manner, by increasing the number of bits only in the display data generated in the variation correcting section 250, an attempt is made to enhance accuracy of the above-described two-dimensional display variation correction.

[Driving Schemes]

Next described are methods for driving the display apparatus in which the cathode current inspection based on the above-described principle is carried out. In the driving methods described below, an example case is explained in which a high-speed inspection scheme is employed which involves successively applying, as the inspection display signal Vsig supplied to a pixel in the inspected row, an inspection ON display signal (for EL emission) and an inspection OFF display signal (for EL non-emission). Although the order of application of the inspection ON display signal and OFF display signal is not particularly limited, the order in the following example is OFF first and then ON.

(Driving Scheme 1)

Figure 7:
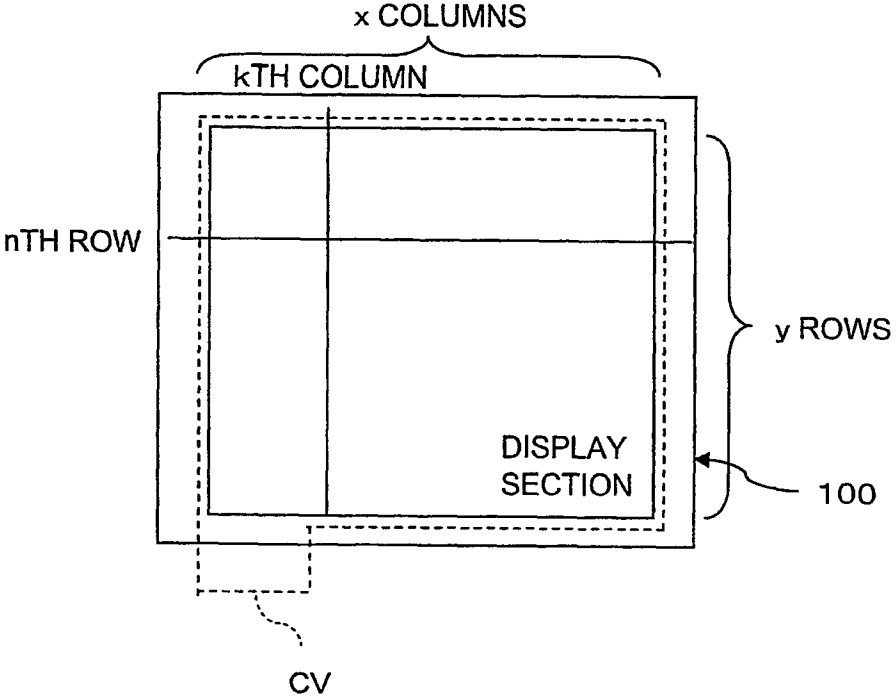
FIG. 7 is a diagram for explaining a panel inspection method according to a preferred embodiment of the present invention.
Figure 8:
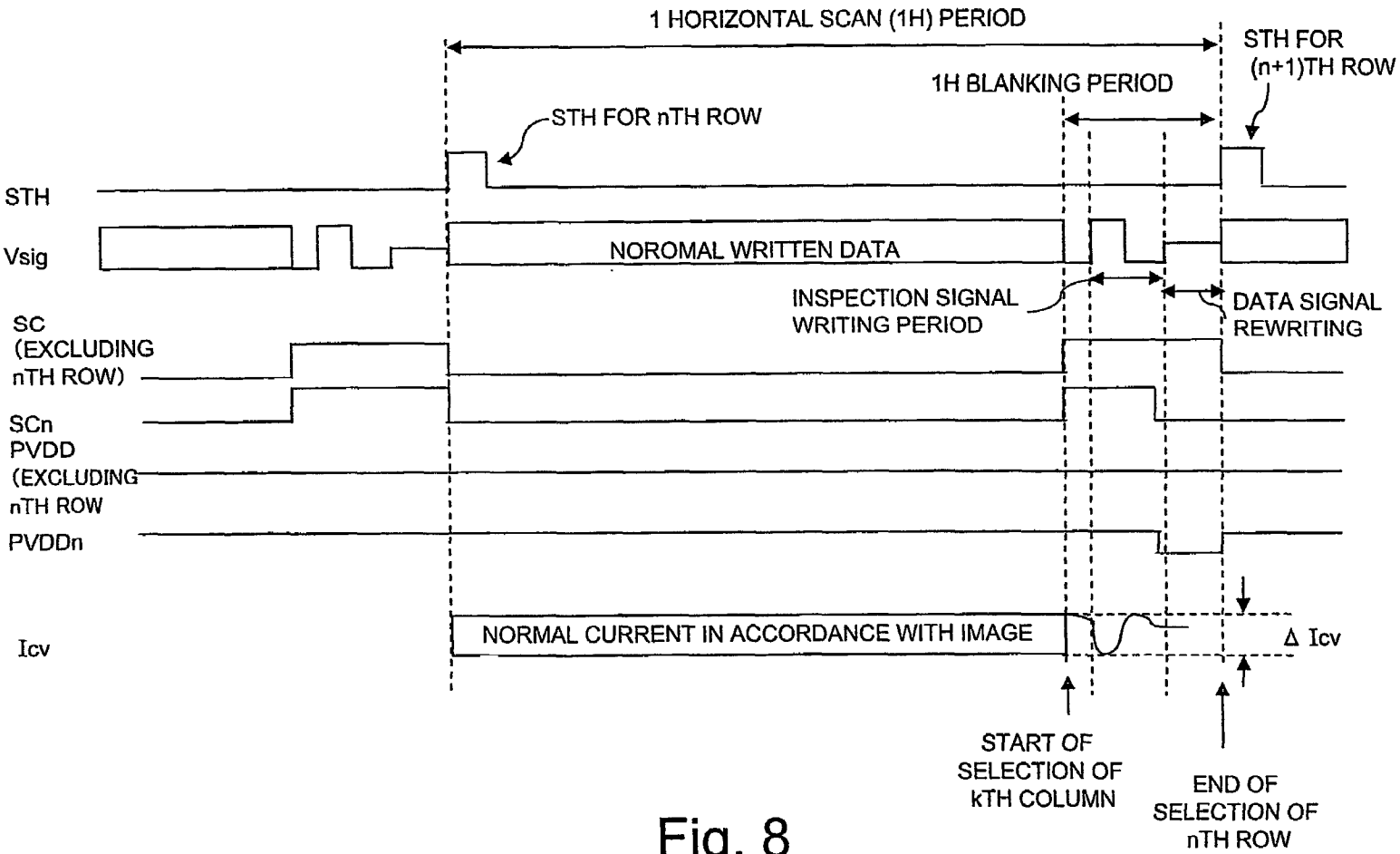
FIG. 8 is a timing chart explaining Driving scheme 1 according to a preferred embodiment of the present invention.

In Driving Scheme 1, as previously mentioned, the cathode electrode is commonly shared by all pixels, and cathode current detection is performed during a horizontal blanking period. FIG. 7 conceptually illustrates the EL panel 100 having y rows and x columns. FIG. 8 shows a timing chart for Driving Scheme 1.

According to Driving Scheme 1, an inspection signal is supplied to a kth-column pixel in certain one row during one horizontal blanking period, and inspection of the kth-column pixels in all rows (n rows) is carried out over one frame period. By repeating this process for y times, cathode current detection is executed for all pixels.

A horizontal start signal STH indicates a start of one horizontal scan (1H) period. As shown in FIG. 8, the period between the rise (transition to HIGH) of STH for nth row and the rise of STH for the subsequent (n+1)th row corresponds to the 1H period for nth row. At the end of the 1H period, a horizontal (H) blanking period is provided. During the period from the rise of STH for nth row to the start of the H blanking period, as in normal operation, all the pixels in the nth row are selected, and, in each selected pixel, display data Vsig is written so that the EL element emits light in accordance with the data to perform display. The emission of the EL element is basically maintained until a data signal for the subsequent frame is written into the same pixel during the subsequent frame period.

According to the present scheme, during the H blanking period within the 1H period for nth row, an inspection signal (inspection ON-OFF display signal) Vsig is supplied from the data line 12 to the pixel in a predetermined column (kth column).

The inspection signal is a signal having a predetermined amplitude which causes the element driving Tr2 of the corresponding pixel to operate in a saturation region as previously explained, and which places the EL element in a non-emission state and an emission state. Accordingly, a current such as cathode current Icv shown in FIG. 8 is obtained from the cathode electrode CV. The cathode current detector 330 detects this current as the ON-OFF cathode current difference ΔIcv.

According to the present scheme, after measuring ΔIcv in the above manner, the data signal Vsig that was retained in the measurement target pixel until immediately prior to the measurement is rewritten into that pixel. This rewriting is performed because the normal written data Vsig becomes lost by writing an inspection signal into the kth-column pixel in the nth row during the 1H blanking period. As such, without performing the rewriting, display cannot be performed after the 1H period for nth row until a new data signal Vsig is written into this kth-column pixel in the nth row during the subsequent frame period.

According to the present scheme, during the blanking period, in order to avoid obstructing the cathode current detection performed during the blanking period, the potential of a capacitance line 14 (SC) provided for every row is set such that the gate-source voltage of the element driving Tr2 |Vg−PVDD| does not exceed the operation threshold value |Vth|, or in other words, the potential of the capacitance line 14 is fixed to a first potential that sets the element driving Tr2 to a non-operation level at which its self-initiated operation is not possible. Accordingly, the EL element 18 connected to the element driving Tr2 remains in a non-emission state, and no cathode current is generated.

When a p-channel type TFT is employed as the element driving Tr2 as shown in FIG. 1, the above-noted first potential is a predetermined HIGH level (such as a level same as PVDD, or HIGH level of the gate line 10).

While the first potential of the capacitance line 14 is explained above as corresponding to a "non-operation level" of the element driving Tr2, when the inspection ON signal is supplied from the data line 12 via the selection Tr1 to the gate of the element driving Tr2, because a storage capacitor Cs is connected to the gate of this element driving Tr2, the gate voltage Vg varies by a potential difference between the potential of the inspection ON signal and a predetermined gate potential fixed by the first potential of the capacitance line 14[*n*]. Accordingly, by using the inspection ON signal to set the gate potential of the element driving Tr2 to a level sufficiently lower than its source potential (PVDD) (when Tr2 is p-channel type), the element driving Tr2 can supply a current to the EL element in response to the inspection ON signal.

During the H blanking period, the level of the capacitance line 14 may be set to a level corresponding to the non-operation level of the element driving Tr2 similarly for all rows. However, according to the present scheme, during the data signal rewriting period, the level of the capacitance line 14[*n*] for nth row which is the inspected row is changed to a second potential that is the same as the potential during normal writing (in this example, the LOW level, which may be GND), such that the rewriting is executed more reliably.

Figure 12:
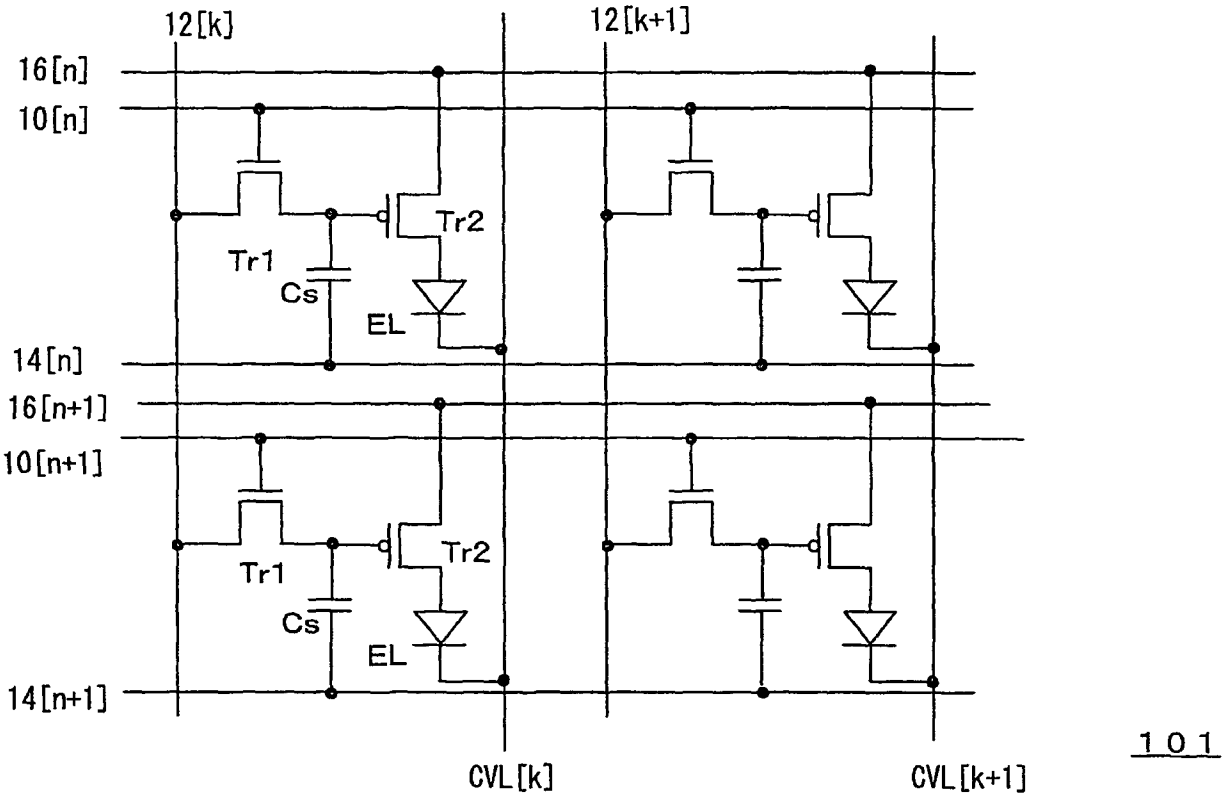
FIG. 12 is a schematic circuit diagram of an EL display apparatus according to a preferred embodiment of the present invention, which shows an example different from the schematic circuit structure of FIG. 1.

When a circuit configuration as shown in FIG. 12 described further below is employed in which a power supply line 16 (PVDD) is formed for every row and its potential can be controlled individually for each row, the level of the power supply line 16[*n*] for the inspected nth row (PVDDn) may be changed to a predetermined LOW level during the data signal rewriting period within the corresponding H blanking period, as shown in FIG. 8. By setting the PVDD potential for this row to LOW level after writing the inspection signal, it is possible to set the EL element to a non-emission state during the data signal rewriting period in which data signal writing is performed. In this manner, it is possible to avoid a situation in which, while all other pixels which are not inspected remain in a non-emission state during the H blanking period, the inspected pixel (or row) emits light and appears brighter during that emission compared to the other pixels not currently inspected.

When the potentials of the capacitance line 14 and the power supply line 16 (PVDD) for the inspected row are controlled as described above, the potential of the capacitance line 14 is preferably fixed at least during the data signal rewriting period. The timing for changing the potential of the capacitance line 14 from the first potential to the second potential is before the start of the rewriting. Concerning the change of potential of the power supply line, as explained above, this potential change from the normal potential to a low potential is directed to achieving the effect of stopping light emission by the EL element which may be caused by the supplying of the inspection signal. As such, from the aspect of reducing any emission period unrelated to display, it is also preferable to carry out the potential change of the power supply line before the start of the rewriting. However, it is also possible to perform this change after the start of the rewriting.

According to Driving Scheme 1 described above, as previously explained, it is possible to detect the cathode current (ΔIcv) regarding all pixels in a VGA panel in a period of slightly less than 11 seconds.

(Driving Scheme 2)

Figure 9:
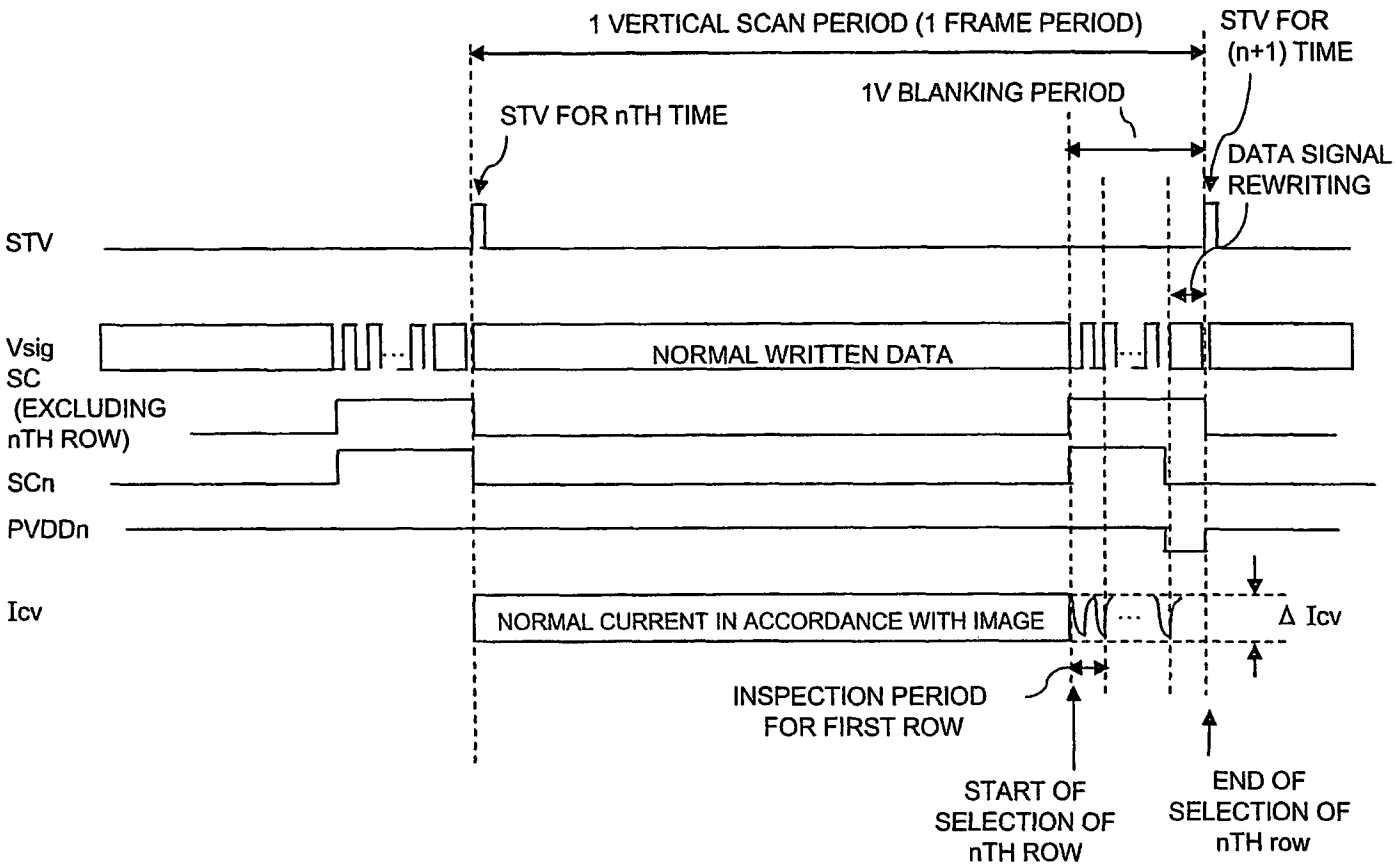
FIG. 9 is a timing chart explaining Driving scheme 2 according to a preferred embodiment of the present invention.

FIG. 9 shows a timing chart for Driving Scheme 2. According to Driving Scheme 2, the cathode electrode is commonly shared by all pixels as shown in FIG. 7, and cathode current detection is performed with respect to all the pixels belonging in one inspected row during one vertical blanking period.

In FIG. 9, the vertical start signal STV indicates a start of one vertical scan (1V) period. The period from the rise of STV for nth time to the rise of STV for (n+1)th time corresponds to the 1V period for nth frame. At the end of the 1V period, a vertical (V) blanking period is provided.

During the period from the rise of STV to the start of the V blanking period, as in normal operation, all pixels in the panel of y rows×x columns are selected, and, in each pixel, display data Vsig is written so that the EL element emits light in accordance with the data to perform display.

According to present Scheme 2, from the start of one V blanking period, all the pixels within the nth row are selected, and the inspection signal (ON-OFF display signal) Vsig is supplied from the data line 12 sequentially to all the pixels within the nth row (from the 1st column to the xth column), thereby sequentially obtaining the cathode current detection results (ΔIcv) during the respective column selection periods (the inspection signal supplying period for the corresponding column). During a period from after completion of the writing of the inspection signal for all columns to the end of the blanking period, with respect to the pixels in all columns of the nth row, the display data signals that have been written in the respective pixels until before the inspection are rewritten. Because the data lines 12 are provided for the respective columns, the data signal rewriting can be performed simultaneously for the individual pixels in all columns of the nth row.

During the V blanking period, similarly to in the H blanking period of the above Scheme 1, it is preferable to set the capacitance lines 14 for all rows to a first potential corresponding to the non-operation potential of the element driving Tr2, and to set only the capacitance line 14[*n*] for the inspected row to a second potential during the rewriting period within the inspection blanking period in order to facilitate the writing.

Further, similarly to in Scheme 1, when the power supply line 16 (PVDD) is provided for each row, as shown for example in FIG. 9, the power supply line PVDDn for the inspected row may be controlled so as to change its potential to a predetermined LOW level during the data signal rewriting period alone. By setting the potential of the power supply line PVDDn for the inspected nth row to LOW level, an instantaneous period of emission by the EL element due to the supplying of the inspection signal can be minimized to a more reduced duration.

According to Driving Scheme 2 described above, as previously explained, it is possible to detect the cathode current (ΔIcv) regarding all pixels in a VGA panel in approximately 8 seconds.

(Driving Scheme 3)

Figure 10:
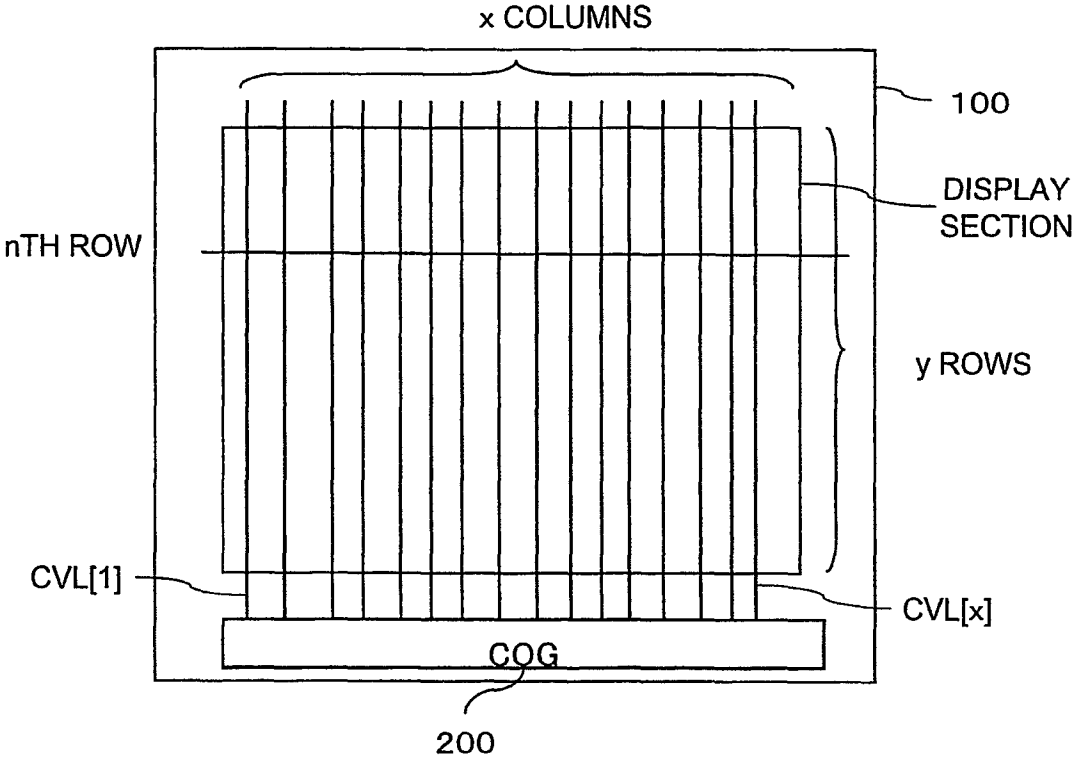
FIG. 10 is a diagram for explaining a schematic structure of a panel in which Driving Scheme 3 according to a preferred embodiment of the present invention is executed.
Figure 11:
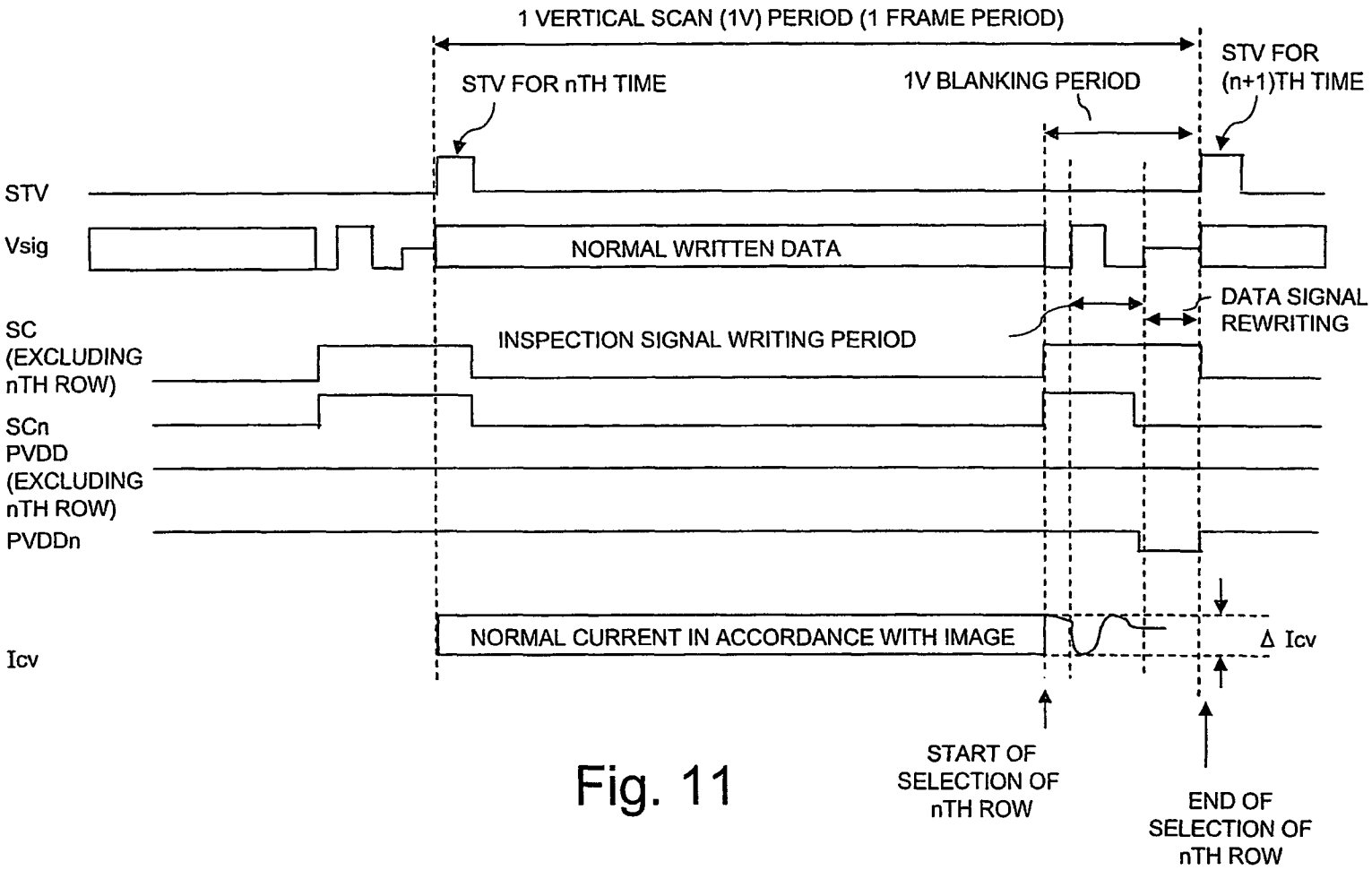
FIG. 11 is a timing chart explaining Driving Scheme 3 according to a preferred embodiment of the present invention.

Driving Scheme 3 is next described referring to FIGS. 10 and 11. According to the present scheme, as in the example panel structure shown in FIG. 10, the cathode electrode is divided corresponding to each column into cathode electrode lines CVL to provide CVL[1]-CVL[x]. Further, the cathode current detection is performed as shown in FIG. 11. More specifically, one inspected row (nth row) is selected during one V blanking period within one vertical scan period for nth time, and cathode current (ΔIcv) values for the respective ones of all the pixels within the nth row (i.e., the nth-row pixels in the first to xth column) are detected at the same time using the cathode electrode line CVL provided for each column.

As in Driving Scheme 2, during a period from after completion of the inspection signal writing period to the end of the corresponding V blanking period, with respect to all the pixels in the nth row, the display data signals that have been written in the respective pixels until before the inspection are rewritten.

Further, as in Driving Scheme 2, it is preferable to execute the potential control of the capacitance lines 14, as well as the power supply potential control in a case in which power supply lines 16 (PVDD) are provided for the respective rows. In other words, during a V blanking period, the capacitance lines 14 are set to the first potential (the non-operation potential of the element driving Tr2), while, during the data signal rewriting period within the vertical blanking period in which nth row is inspected, only the capacitance line 14[*n*] for the inspected row is set to the second potential. Concerning the power supply lines, only the power supply line PVDDn for the inspected row is set to the predetermined LOW level during the data signal rewriting period so as to stop emission by the EL element due to the supplying of the inspection signal. The timings of potential change of the capacitance line 14[*n*] and the power supply line PVDDn are set such that they do not occur during the data signal rewriting period. In particular, the potential change of the capacitance line 14[*n*]) is avoided during data signal rewriting period.

According to the Driving Scheme 3 described above, the cathode current detection for one row can be executed during one V period, such that the cathode current detection regarding all pixels can be carried out in approximately 8 seconds, as previously explained. As the cathode electrode is divided corresponding to the respective columns in Driving Scheme 3, unlike in Driving Scheme 2, the entire duration of 1V blanking period other than the data signal rewriting period can be employed as the inspection period for each one of the columns. As such, it is possible to reduce the work load of the driving circuit that outputs the inspection signals to the data lines 12 and to reduce power consumption.

The divided cathode electrode lines CVL[1]-CVL[x] in the present scheme are individually connected to an integrated driving circuit (driving section) 200 mounted on a panel substrate by a COG (Chip On Glass) technique, as shown in FIG. 10. In the driving section 200, for example, one current detection amplifier 332 as shown in FIG. 4 may be provided for each of the cathode electrode lines CVL[1]-CVL[x], in one-to-one relationship. With this arrangement, the cathode current detection can be executed simultaneously for all cathode electrode lines (i.e., all columns).

Alternatively, by correlating one current detection amplifier 332 with multiple lines (such as ten lines), it is possible to reduce the number of current detection amplifiers. Such reduction of the number of amplifiers can contribute to reduction of area of the driving section. When one current detection amplifier 332 is provided corresponding to a multiple number of power supply lines, the inspection can be carried out using the driver configuration identical to the driving section that carries out the operation shown in FIG. 11 by repeating the pixel cathode current detection process with respect to one row for a number of times (such as ten) corresponding to the number of power supply lines correlated to one amplifier.

If is of course possible to divide the detection signal writing period within 1V blanking period in accordance with the number of power supply lines correlated to one amplifier, and to sequentially detect the cathode current values from the respective correlated power supply lines CVL. In this manner, the cathode current detection regarding all pixels can be executed within the same duration as in FIG. 11.

The driving section 200 in FIG. 10 not only performs the individual detection of the cathode currents from the cathode electrode lines but also has the functions shown in FIGS. 3 and 4 described above, and carries out driving of the display section, variation detection, variation correction, and the like. Furthermore, although not shown in FIG. 10, a part or all of the functions of the driver 220 within the driving section 200 shown in FIG. 3 may be formed separately from this COG as an H driver and a V driver which are integrally formed on the panel substrate together with the pixel circuit of the display section.

Moreover, as previously explained, Driving Scheme 3 in which the cathode current lines are provided for the respective columns can also be adopted into a method in which the cathode current detection is performed during a horizontal blanking period within one horizontal scan period.

FIG. 12 is a diagram showing a schematic circuit structure of a pixel circuit with which the above-described Driving Scheme 3 can be implemented. In FIG. 12, the features that differ from the circuit structure shown in FIG. 1 are that the power supply lines 16 (PVDD) are not provided along the column direction but are provided along the row direction for the respective rows, and that the cathode electrode lines CVL are provided for the respective columns. When the cathode electrode is formed as the upper electrode while the anode electrode is formed as the lower electrode in the EL panel 100, the cathode electrode lines CVL can be provided by forming the cathode electrode disposed on the EL layer in shapes separated for each column. It should be noted that, also in Driving Schemes 1 and 2, when the potential of the power supply line 16 (PVDD) is to be controlled separately for each row as described above, the power supply lines 16 are formed along the row direction as shown in FIG. 12.

[Inspection Control Signal Generation Circuit]

Figure 13:
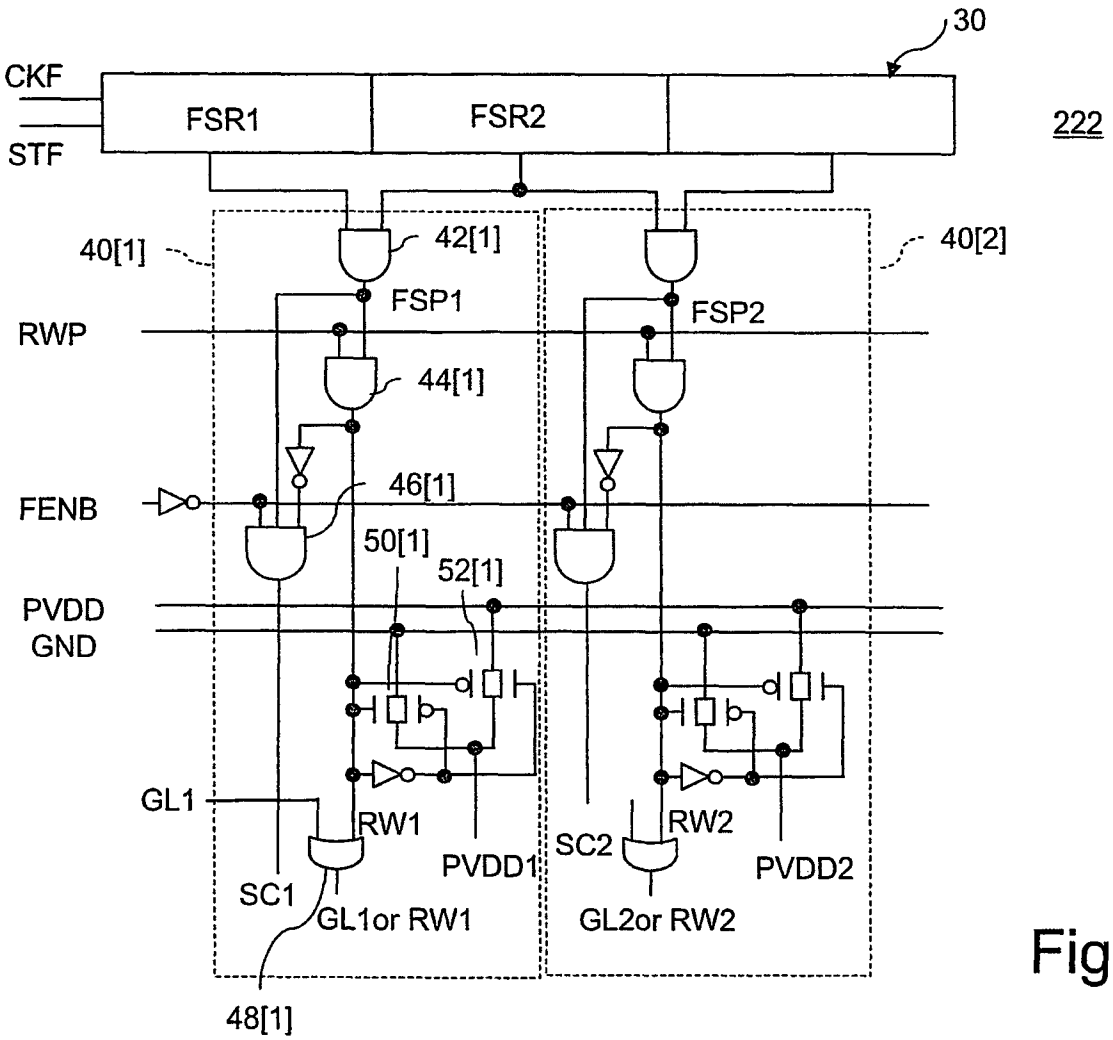
FIG. 13 is a diagram showing an example circuit for generating an inspection control signal according to a preferred embodiment of the present invention.
Figure 14:
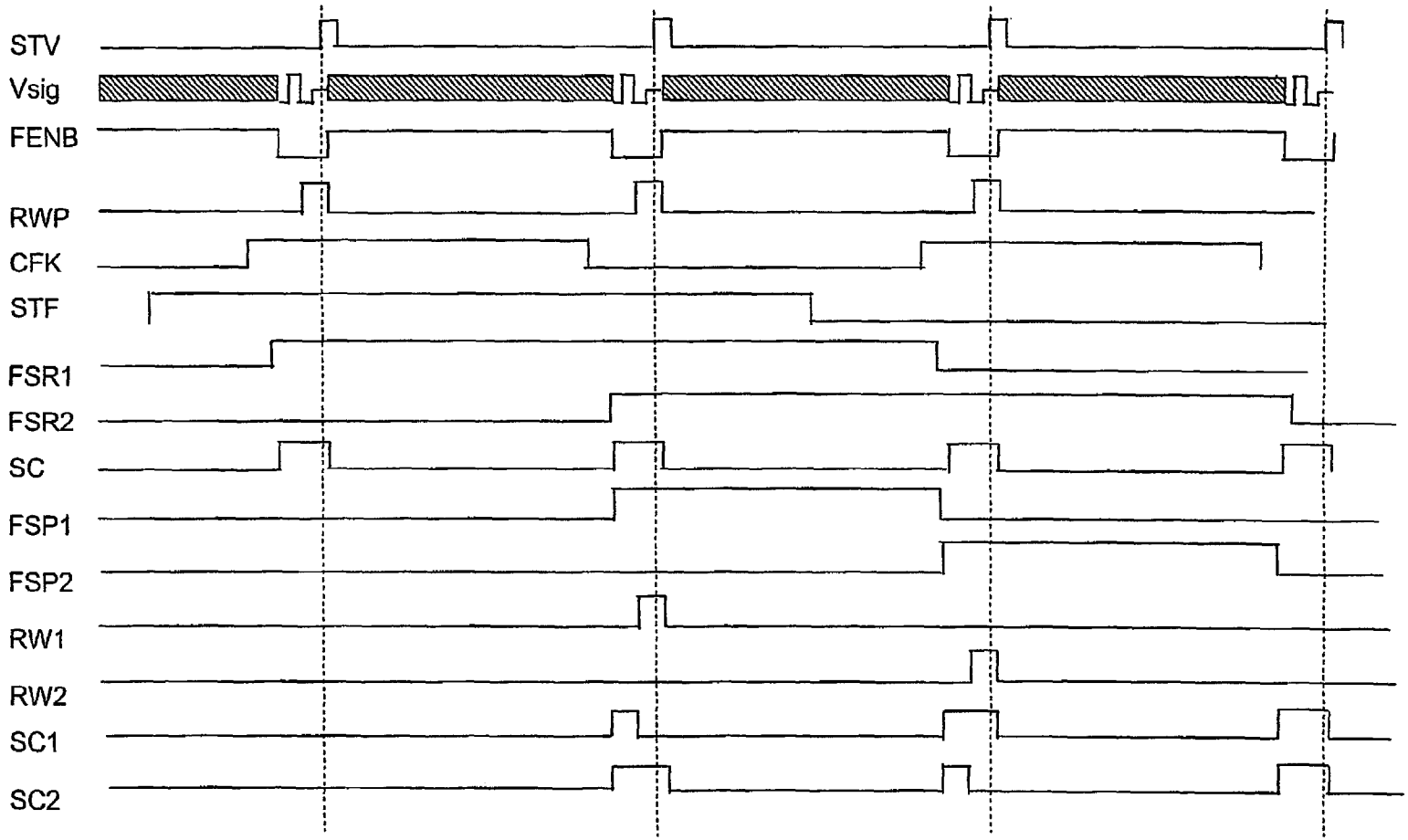
FIG. 14 is a timing chart explaining the operation of the circuit structure of FIG. 13.

FIG. 13 shows an inspection control signal generation circuit 222 which controls, during the cathode current inspection according to Driving Scheme 3, the respective lines (i.e., gate lines 10, capacitances line 14, and power supply lines 16) provided along the row direction. This circuit 222 can be built into the V driver 220V or the like, for example. Further, FIG. 14 is a timing chart explaining the operation of the circuit shown in FIG. 13.

A shift register 30 for generating an inspection control signal includes registers FSR in accordance with the number of rows in the display section. The FSR are supplied with a frame start signal STF and a frame clock signal CKF which are generated by a circuit structure not shown based on the vertical start signal STV, the dot clock signal, and the like. A frame start signal STF is a signal which determines the timing of start of inspection for each row. When the inspection is performed by selecting only one row during 1V blanking period as in Driving Scheme 3, the frame start signal STF rises to HIGH at every y frame periods corresponding to the number of rows (y) in the panel. A frame clock signal CKF is a signal having a period double of one frame period.

The shift register 30 for the cathode current detection transfers the frame start signal STF, in response to the frame clock signal CKF, sequentially from one register FSR to a FSR of the subsequent stage. The respective registers FSR1, FSR2, and so on output register outputs FSRP1, FSRP2, and so on, respectively, to corresponding control signal creating sections 40 [1], 40 [2], . . . 40[*y*] for the respective rows.

The structure and the operation of the signal creation logic section 40 are next explained using the signal creation logic section 40[1] as an example. First, an AND gate 42[1] is supplied with the output from register FSR1 of its own stage and the output from register FSR2 of the subsequent stage, and the resulting logical product FSP1 is supplied to a first input terminal of an AND gate 44[1]. A second terminal of the AND gate 44[1] is supplied with are write control signal RWP which indicates the data signal rewriting period during the V blanking period. The rewrite control signal RWP is set to HIGH level only during the above-described rewriting period. When logical conjunction FSP1 having HIGH level is output from the AND gate 42[1] during when the rewrite control signal RWP is HIGH, the AND gate 44[1] generates a rewrite selection signal RW1 for selecting a rewriting row.

The rewrite selection signal RW1 is supplied to a first input terminal of an OR gate 48[1]. A second input terminal of the OR gate 48[1] is supplied with a selection signal which is sequentially output to the gate lines 10 during normal operation and the like. A logical sum of this selection signal and the rewrite selection signal RW1 output to the inspected row during the cathode current detection is obtained, and is output to the corresponding gate line 10 as the selection signal (GL1 or RW1). During when the inspection signal (inspection ON-OFF signal) Vsig is output, the selection signal is output to the gateline 10 of the inspected row. Accordingly, when the first row is the inspected row for example, during the inspection signal writing period, GL1 having HIGH level is output from the OR gate 48[1], and, during the rewriting period, RW1 having HIGH level is output.

The output RW1 from the AND gate 44[1] is supplied via an inverter to a first input terminal of an AND gate 46[1]. A second input terminal of the AND gate 46[1] is supplied with the output FSP1 from the AND gate 42[1], while a third input terminal of the AND gate 46[1] is supplied with a signal (equivalent to the capacitance line signal SC) which is an inverted signal of a frame enable signal FENB. Accordingly, when the capacitance line signal is set to HIGH level and the corresponding row is being inspected, the AND gate 46[1] generates the capacitance line signal SC1 which is set to HIGH level (the first potential) only during the inspection signal writing period, and outputs SC1 to the capacitance line 14[1].

Further, the output RW1 from the AND gate 44[1] is supplied to a drive power supply control section that controls the power supply potential PVDD which is output to the power supply line 16 (VL). This drive power supply control section includes CMOS gates 50[1] and 52[1]. In the CMOS gate 50[1], the above-described RW1 is supplied to the gate of its n-channel TFT, while an inverted output of RW1 is supplied to the gate of the p-channel TFT. Accordingly, when RW1 is set to HIGH level, this CMOS gate 50[1] performs an ON operation, such that a GND power supply connected to its input side terminal is connected via the output side terminal to the power supply line 16.

On the other hand, in the CMOS gates 52[1], the above-described RW1 is supplied to the gate of its p-channel TFT, while an inverted signal of RW1 is supplied to the gate of the n-channel TFT. Accordingly, when RW1 is set to LOW level, the CMOS gate 52[1] performs an ON operation, such that a PVDD power supply connected to its input side terminal is connected via the output side terminal to the power supply line 16.

As shown in FIG. 14, RW1 is selectively set to HIGH level during the data signal rewriting period only with respect to the inspected row. Accordingly, the power supply potential output to the corresponding power supply line 16[1] is controlled to the GND potential during the data signal rewriting period, and, during times other than the rewriting period, is controlled to the PVDD potential. As described above, using the inspection control signal generation circuit 222 of FIG. 13, it is possible to control the writing operation and the writing period of the inspection signal for each row, the capacitance line potential, and the power supply line potential during the V blanking period.

Figure 15:
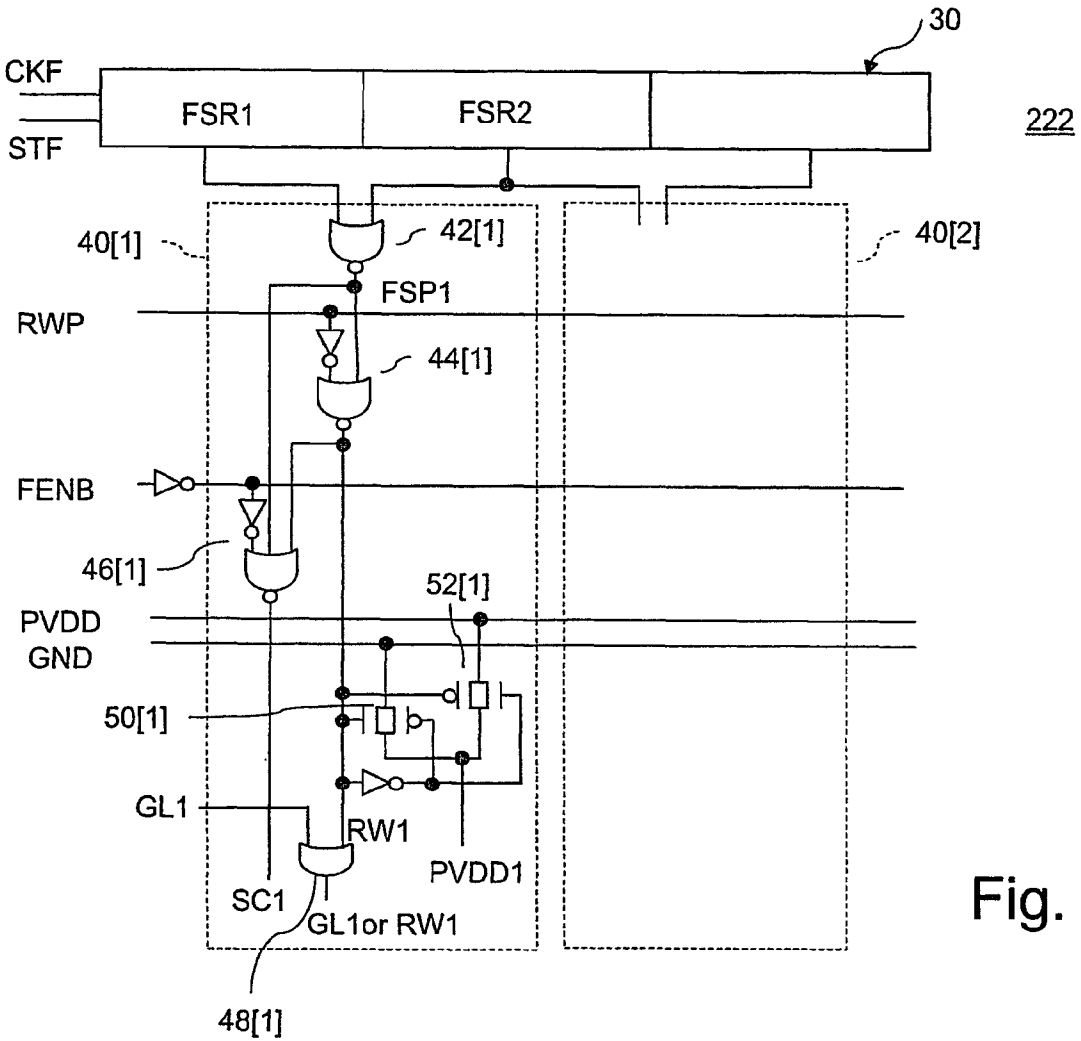
FIG. 15 is a diagram showing a specific example of an inspection control signal generation circuit according to a preferred embodiment of the present invention.

FIG. 15 shows a specific example of the inspection control signal generation circuit 222 shown in FIG. 13. Within an IC, it is preferable to use NOR gates for achieving the logical multiplications shown in the signal creation logic section 40 of FIG. 13. In FIG. 15, NOR gates and inverters are employed to execute the logical conjunctions equivalent to those in FIG. 13. Referring to the signal creation logic section 40[1] for example, NOR gate 42[1] obtains an inverted logical sum FSP1' of the outputs from FSR1 and FSR2, and this FSP1' is supplied to one input terminal of NOR gate 44[1] and one input terminal of NOR gate 46[1].

The NOR gate 44 [1] obtains an inverted logical sum of FSP1' and an inverted input of RWP, and outputs a rewrite selection signal RW1. As in FIG. 13, this rewrite selection signal RW1 is supplied to the CMOS gates 50[1] and 52[1] and the OR gate 48[1]. Further, the NOR gate 46[1] receives input of the above-noted RW1, FSP1', and an inverted signal (i.e., a signal in-phase with FENB) of the inverted signal of the frame enable signal FENB. The NOR gate 46[1] obtains an inverted logical sum of these three signals, and outputs the obtained sum to the capacitance line signal SC1.

[Current Detection Amplifier]

Figure 16:
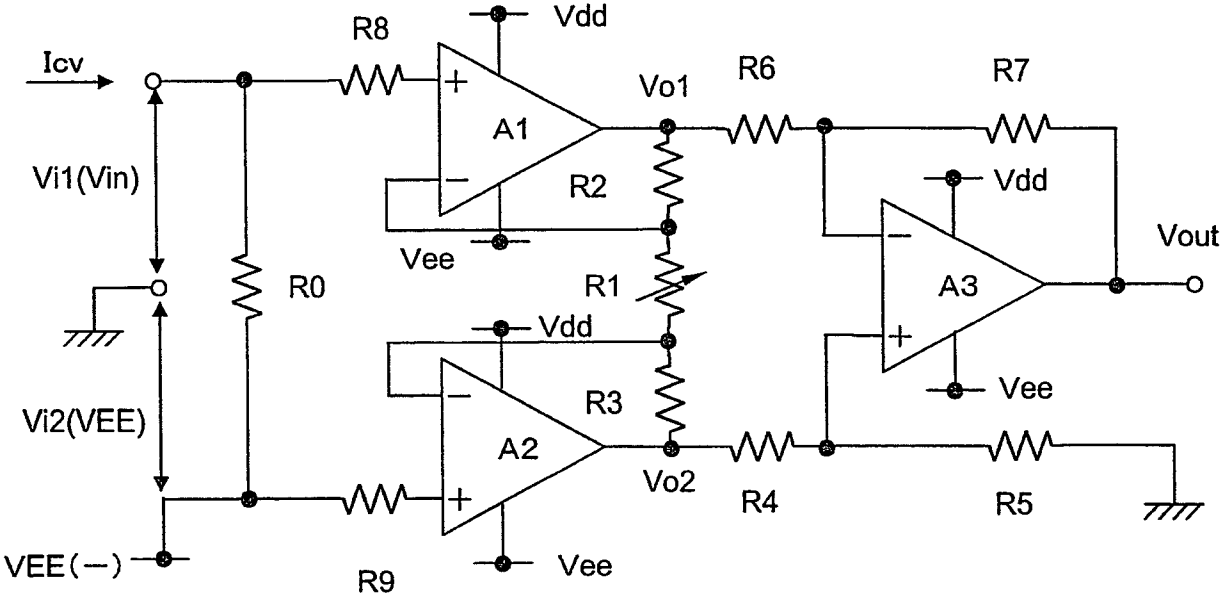
FIG. 16 is a diagram showing an example current detection amplifier according to a preferred embodiment of the present invention.

An example structure of the current detection amplifier 332 is next described. Instead of the current detection amplifier 332 shown in FIG. 4, it is possible to alternatively employ an amplifier as shown in FIG. 16 in order to detect the cathode current. The amplifier of FIG. 16 has a type of structure of an instrumentation amplifier, and includes three operational amplifiers A1, A2, and A3. The operational amplifiers A1 and A2 constitute a differential circuit, and the operational amplifier A3 functions as a differential amplifier circuit that amplifies the differential output of the operational amplifiers A1 and A2. By employing such an instrumentation amplifier as the current detection amplifier, it is possible to easily detect the cathode current at high accuracy without being susceptible to influences of noise.

Between the output terminals P1 and P2 of the operational amplifiers A1 and A2, resistors R2, R1, and R3 are serially connected. The connecting point between the resistors R2 and R1 is connected to the negative input terminal of the amplifier A1. Further, the connecting point between the resistors R3 and R1 is connected to the negative input terminal of the operational amplifier A2.

Meanwhile, a current detection resistor R0 is connected between the positive input terminals of the operational amplifiers A1 and A2, and the positive input terminal of the operational amplifier A1 is supplied with the cathode current Icv. The positive input terminal of the operational amplifier A2 is supplied with a negative power supply voltage VEE serving as an input signal Vi2. An input signal Vi1 (Vin) input into the positive input terminal of the operational amplifier A1 has a value in accordance with a voltage (Icv*R0) generated when the cathode current Icv flows through the current detection resistor R0 as well as in accordance with the negative power supply voltage VEE, and is expressed as VEE+Icv*R0.

When the output from the operational amplifier A1 is denoted as Vo1 and the output from the operational amplifier A2 is denoted as Vo2, Vo1 and Vo2 are expressed by the following equations (3) and (4):

$$Vo1 = \left(1 + \frac{R2}{R1}\right)Vin - \frac{R2}{R1} \cdot VEE \tag{3}$$

$$Vo2 = \left(1 + \frac{R3}{R1}\right)VEE - \frac{R3}{R1} \cdot Vin \tag{4}$$

A difference between the above two outputs is the output from the differential circuit section, which is expressed by equation (5) below:

$$Vo1 - Vo2 = (Vin - VEE)\left(1 + \frac{R2 + R3}{R1}\right) \tag{5}$$

Here, resistance values of resistor R6 connected to the negative input terminal side of the operational amplifier A3 and resistor R4 connected to the positive input terminal side of the operational amplifier A3 are equal. Further, resistance values of resistor R7 provided in the negative feedback path of the operational amplifier A3 and resistor R5 provided between GND and the positive input terminal of the operational amplifier A3 are equal. An output Vo from the operational amplifier A3 configured as above is expressed with respect to the ground potential by the following equation (6):

$$Vo = \frac{R7}{R6}(Vin - VEE)\left(1 + \frac{R2 + R3}{R1}\right) \tag{6}$$

In the example shown in FIG. 16, as explained above, the negative power supply voltage VEE is supplied as the input signal into the positive input terminal of the operational amplifier A2 in the instrumentation amplifier. For the purpose of accurately detecting the cathode current under a condition in which the EL panel is driven with the element driving Tr2 being operated in the saturated state (i.e., under a condition equivalent to normal display operation), the cathode power supply is set to a potential lower than 0V such as −3V. In order to detect a cathode current at such a potential level, a negative power supply VEE having a potential of a similar level (such as −3V) is required as the input signal Vo2 for comparison. Further, as an operation power supply of the respective operational amplifiers A1-A3, a positive operation power supply Vdd and a negative operation power supply Vee are necessary. As the negative operation power supply Vee, a voltage lower than VEE is required. For example, the level of ±15V is employed for Vdd and Vee.

In a display apparatus employing the EL panel 100 or the like, when a large negative power supply is necessary, such power supply is typically produced using a charge pump circuit, a switching regulator circuit, and the like, from a relatively small negative voltage (such as −1V) used as a power supply for an IC. The negative power supplies VEE, Vee produced using a charge pump circuit or the like tend to include overlapped ripple components. Meanwhile, the cathode current detected in the embodiments of the present invention is very small. Accordingly, if the negative power supplies VEE, Vee produced as noted above were employed as a reference power supply for a highly-sensitive current detection amplifier, there are possibilities that the detected results may be influenced by noises such as the ripples of the negative power supplies.

However, the output from the instrumentation amplifier having the structure as shown in FIG. 16 is not susceptible to influences from the power supplies Vdd, Vee of the respective operation amplifiers. Furthermore, because the input signal Vin into the operation amplifier A1 is expressed as VEE+Icv*R0 as explained above and the output signal Vo is shown by the above equation (6), the negative power supply VEE is cancelled from the final output signal Vo. Accordingly, even when the current inspection is executed under a power supply condition identical to that for normal display, by employing the instrumentation amplifier having the structure as shown in FIG. 16 as the current detection amplifier, it is possible to accurately detect very weak cathode currents while avoiding overlap of noises.

It is noted that the negative power supply voltage VEE preferably is a voltage similar to the cathode power supply voltage Vcv. In a case in which the same drive power supply PVDD used during normal operation is also used as the drive power supply PVDD during the current inspection, VEE and Vcv are set to a potential of approximately −3V, for example.

On the other hand, in a case in which the potential of PVDD during the current inspection is set higher by ΔV compared to during normal operation, the cathode power supply voltage Vcv and the negative power supply voltage VEE can also be increased by ΔV to adopt a potential of approximately 0V (GND), for example. In this case, a voltage (such as ±10V, or approximately ±5V) which is smaller by at least ΔV can be used as the drive power supplies Vdd, Vee for the amplifiers A1-A3. In this manner, it is possible to further avoid influences from a charge pump circuit or the like, and to reduce power consumption in the current detection amplifier. Moreover, in a case in which the IV characteristic of the EL material of the EL element draws a sufficiently steep curve, a desired current Icv can be obtained using a small voltage amplitude difference. Accordingly, in this case too, the power supply voltage range of the instrumentation amplifier can be set to a smaller range, such that it is possible to achieve advantages such as low power consumption as well as enhancement of the detection accuracy by the use of the GND potential.

[Other Aspects]

While the above schemes and structures are explained referring to a case in which the cathode current detection for each pixel is performed in real time, the current detection and the correction processing may be executed at the time of activating the display apparatus. It is of course possible to measure the cathode current (ΔIcv) for each pixel and store the correction data in advance at the time of shipment from the factory, and to occasionally update the correction data or to perform real-time correction by detecting characteristic variation over time. In particular, according to the present embodiment, the cathode current detection data measured at the time of shipment from the factory (i.e., the initial data) are stored in the secondary memory 344 of the memory section 340, such that, at the time of power activation after shipment from the factory, the initial data can be used to execute the correction.

In the correction by the variation correcting section 250 described above, the calculation processing and correction processing methods are not particularly limited as long as a data signal supplied to a pixel in which display variation occurs is adjusted to a suitable level and the emission brightness of the EL element is corrected.

By integrating the above-described variation correcting section 300 together with the panel controller 210, it is possible to provide a display apparatus capable of executing the detection and correction of display variation and the control (i.e., display operation) of the display section using a very small driving section. Further, the structures within the variation correcting section 300 such as the AD converter and the memory can be commonly shared with the circuit of the panel controller 210. Forming the driving section 200 into an IC by implementing such sharing can contribute to reduction of the IC chip size.

In order to create the correction data for all pixels by an approach such as the above-described Driving Schemes 1-3, it takes time of approximately 10 seconds or more, for example. For this reason, when the cathode current detection is always executed sequentially from pixels in the uppermost row upon turning on the apparatus power, in a display apparatus in which each actuation period is short, particularly as the inspection time becomes longer, the cathode current detection is repeated more often with respect to those pixels in the upper region.

In light of the above, it is possible to configure such that the inspection controller 310 or the like shown in FIG. 3 stores the last pixel address at which the supplying of the inspection signal and the cathode current detection we reexecuted before turning off of the apparatus power. Alternatively, the pixel address at which the inspection is executed may be constantly monitored. When the apparatus power is subsequently turned on, control can be performed to start the inspection from the pixel following the last pixel that was previously inspected. When this control is performed, the writing of data (data updating) in the primary memory 342 is carried out regarding data corresponding to the pixel address following the pixel address at which the writing was performed immediately before turning off power. This type of inspection target control and memory writing control can be performed by, for example, using a counter to count the horizontal start signal STH and the vertical start signal STV in a case in which the inspection is executed every H blanking period, or to count the above-noted frame start signal STF generated from the start signals STH and STV, in order to identify the latest inspected pixel address and the pixel address at which the latest correction data was obtained. It is apparent that any methods other than the use of the counter can be employed to control the inspected pixel address and the memory writing address. Concerning the pixel to be inspected at the time of turning on power, when the pixel inspected at the immediately previous instance of turning off power was located at a midpoint of a row in the matrix of the panel, at the subsequent instance of turning on power, the inspection may be executing starting from the leading pixel (in the leading column) of that row. When the target pixel to be inspected after turning on power is selected such that the inspection is executed starting from a pixel address following the pixel inspected before turning on power, instead of the control signal generation circuit as shown in FIGS. 13 and 15, a circuit structure capable of starting the inspection at an arbitrary row and column according to an instruction from the inspection controller 310 shown in FIG. 3 is employed. Although this circuit structure may be configured as a part of the V driver 210V incorporated together with the pixel circuit on the display panel 100, because the circuit size becomes rather large in order to actualize this type of function, it is preferable to form the V driver 210 and the above control signal generation circuit structure on an integrated circuit and to mount this IC on the panel using a COG method or the like. The IC in this case can have incorporated therein all structures shown as the driving circuit 200 in FIG. 3.

Figure 17:
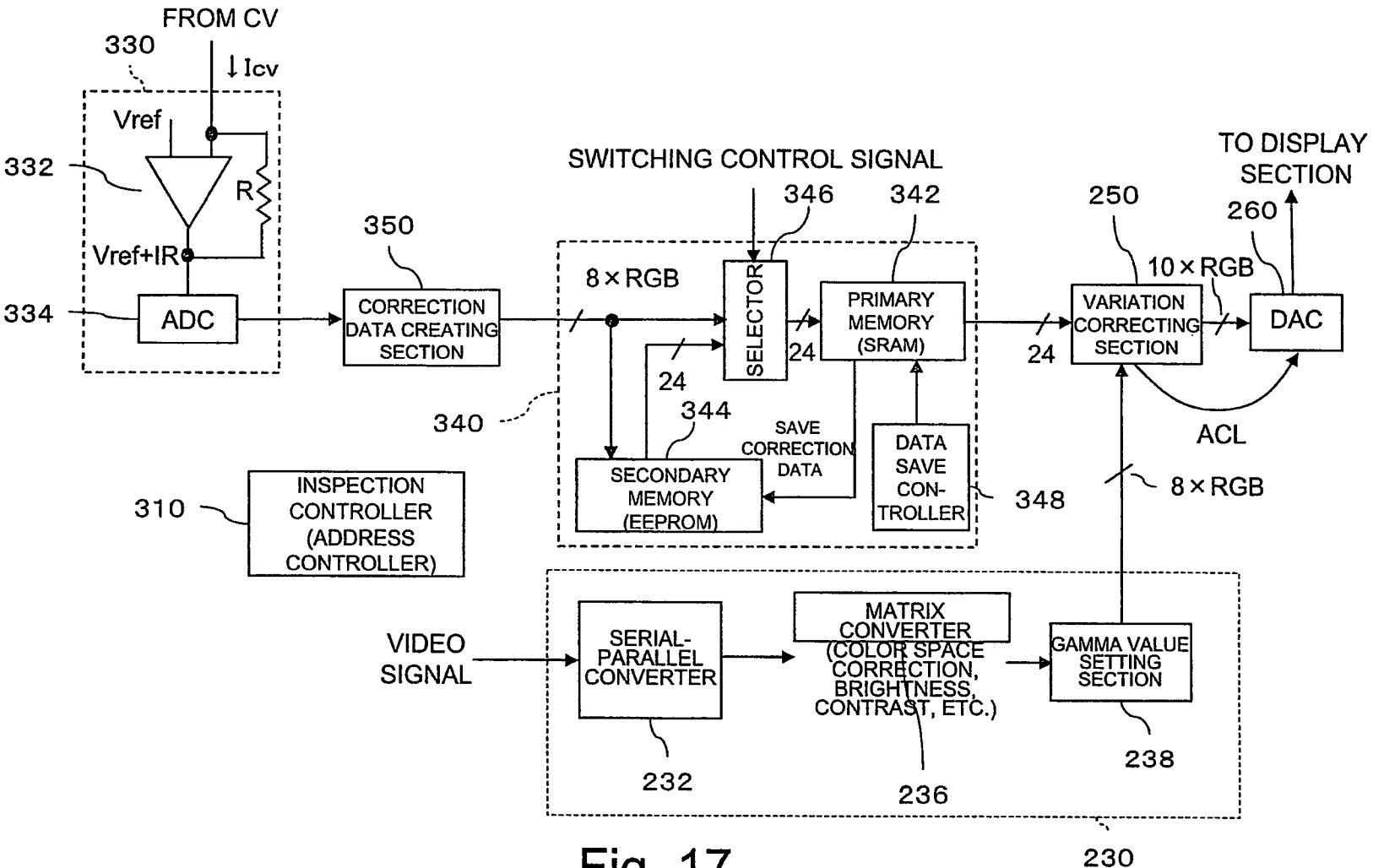
FIG. 17 is a diagram showing a configuration of the driving section of FIG. 3 which differs from that shown in FIG. 4.

Next, a driving section 200 having a structure different from that shown in FIG. 4 is described referring to FIG. 17. The features that differ from FIG. 4 are that, in the example structure of FIG. 17, the correction data creating section 350 uses the output data from the cathode current detector 330 to create the correction data for the respective pixels, the correction data are supplied to the memory section 340 and stored therein, and the variation correcting section 250 uses the correction data read out from the memory section 340 to sequentially execute the two-dimensional display variation correction with respect to the video signal.

In the correction data creation processing by the correction data creating section 350, when the maximum threshold value Vth(i) max among the element driving Tr2 in all pixels is known, other aspects are similar to those described above. More specifically, the threshold value Vt for each corresponding pixel which can be obtained using the sequentially-acquired cathode current detection data is calculated according to equation (1), and $[Vsig_{max}-\Delta Vth(i)]$ is calculated using the obtained threshold value Vt (i) and the above $Vth(i)_{max}$. In this manner, it is possible to sequentially obtain the correction data which serve as the reference for the initial correction data RSFT(init) which is used for calculation in the variation correcting section 250. In the example of FIG. 17, prior to the creation of the correction data, the correction data creating section 350 sequentially obtains the differences ΔIcv from the cathode current detection data which are generated in response to the inspection ON display signal and the inspection OFF display signal and supplied from the cathode current detection section 330.

As shown in FIG. 17, the obtained correction data is once stored in the primary memory 342, and then supplied to the variation correcting section 250 at timings requested by the variation correcting section 250. As explained referring to FIG. 4, similarly in the example of FIG. 17, the primary memory 342 is a memory capable of being read and written at a high speed, and is typically a volatile memory (such as an SRAM). As such, a non-volatile memory is employed as the secondary memory 344 in order to save the correction data stored in the primary memory 342 into the secondary memory 344 at predetermined intervals (such as once every day). Every time the apparatus power is turned on, the correction data stored in the secondary memory 344 is supplied to the primary memory 342 in accordance with control by the selector 346. According to this method, it is similarly possible to execute the two-dimensional display variation correction from immediately after the power is turned on. Regarding the maximum threshold value $Vth(i)_{max}$ of the element driving transistors Tr2, the maximum value among the threshold values of the element driving transistors Tr2 in all pixels is acquired in advance at the time of shipment from the factory, and this maximum value is stored in the secondary memory 344, the correction parameter setting section 280 shown in FIG. 3, or the like. During normal display operation, when operation threshold value data for the element driving transistors Tr2 in all pixels are acquired, the $Vth(i)_{max}$ value set at the time of shipment from the factory can be updated at predetermined intervals, thereby enabling to further enhance the correction accuracy. Modifications concerning other portions can be similarly applied to the example of FIG. 17 as described above for FIG. 4 to achieve similar effects.

In FIG. 17, the correction data from the correction data creating section 350 is supplied to both the selector 346 and the secondary memory 344. Because it is not particularly necessary to directly supply correction data to the secondary memory 344 after shipment from the factory, this data supply path to the secondary memory 344 may be omitted. This data supply path can be employed in cases such as when directly writing the correction data into the secondary memory 344 before shipment from the factory.

In the driving section 200 shown in FIGS. 4 and 17, the writing of data into the primary memory 342 and the secondary memory 344 can be executed every time data is obtained from the cathode current detector 330 (or from the correction data creating section 350). Alternatively, a line memory or the like may be provided before these memories so as to sequentially perform an updating process every time a predetermined amount (such as one row) of data is accumulated, thereby enlarging the intervals at which data writing into the memories is performed.

Moreover, although in the above description, an example configuration is shown in which a cathode current (for example, ΔIcv) of the EL element is used as the current to be measured during inspection of the display variation, the inspection can be executed based on any current Ioled (ΔIoled) flowing through the EL element. As the current Ioled flowing through the EL element, for example, it is also possible to use the anode current Iano in place of the cathode current Icv. When a structure in which the cathode electrode is set as the individual electrode for each pixel of an EL element and the anode electrode is set as the electrode common to a plurality of pixels is employed in place of the structure in which the anode electrode is set as the individual electrode and the cathode electrode is set as the common electrode, the anode current (ΔIano) which is a current flowing through the common electrode may be measured.

What is claimed is:

1. An electroluminescence display apparatus, comprising:

a display section having a plurality of pixels arranged in a matrix, a variation detecting section which detects an inspection result of a display variation in each pixel, and a correcting section which corrects the display variation, wherein each of the plurality of pixels in the display section comprises an electroluminescence element having a diode structure, and an element driving transistor which is connected to the electroluminescence element and controls a current that flows through the electro luminescence element;

wherein the variation detecting section comprises:

an inspection signal generator which generates an inspection signal to be supplied to a pixel in a row to be inspected and supplies the inspection signal to the pixel in the inspected row at a predetermined timing during execution of a display in accordance with a video signal;

a current detector which detects a current that flows through the electroluminescence element in response to the inspection signal;

a memory section which stores a data corresponding to the current detected by the current detector;

wherein the memory section includes a volatile primary memory which stores the data corresponding to the current supplied from the current detector, a non-volatile secondary memory which stores and maintains therein the data stored in the primary memory during when the apparatus power supply is turned off, and a selector which selectively supplies the data stored in the secondary memory to the primary memory when the apparatus power supply is turned on;

wherein the correcting section executes a correction with respect to the video signal for each pixel in accordance with the data read out from the primary memory of the memory section;

wherein during a blanking period, the inspection signal generator supplies, as the inspection signal to the pixel in the inspected row, an inspection ON signal and also an inspection OFF signal that sets the electroluminescence element to a non-emission level;

a current detection amplifier detects an ON current obtained during application of the inspection ON signal and an OFF current obtained during application of the inspection OFF signal; and the memory section stores a data corresponding to a current difference between the detected ON current and OFF current;

wherein the electroluminescence elements in the plurality of pixels have a common cathode;

wherein the current detector detects cathode current at the common cathode; and wherein after inspection, the video signal that was previously supplied and used for driving the electroluminescence element is again supplied to the pixel that was inspected.

2. The electroluminescence display apparatus as defined in claim 1, wherein the correcting section executes the correction with respect to the video signal for each pixel using a correction data corresponding to a characteristic variation amount of the element driving transistor created by a correction data creating section based on the data read out from the primary memory.

3. The electroluminescence display apparatus as defined in claim 1, wherein the data corresponding to the current supplied from the current detector to the memory section is a correction data created by a correction data creating section based on the current detected by the current detector and in accordance with a characteristic variation amount of the element driving transistor.

4. The electroluminescence display apparatus as defined in claim 1, wherein the blanking period is a horizontal blanking period; and during a predetermined horizontal blanking period, the current difference between the ON current and the OFF current is detected sequentially for the pixels in the inspected row and is sequentially stored in the memory section.

5. The electroluminescence display apparatus as defined in claim 1, wherein the blanking period is a vertical blanking period; and during the vertical blanking period, the current difference between the ON current and the OFF current is detected sequentially for the pixels in the inspected row and is sequentially stored in the memory section.

6. The electroluminescence display apparatus as defined in claim 1, wherein in the memory section, a data save controller operates to save the data stored in the primary memory into the secondary memory at a predetermined timing.

7. The electroluminescence display apparatus as defined in claim 1, wherein the current that flows through the electroluminescence element is a cathode current.

8. An electroluminescence display panel driving apparatus, comprising:

a variation detecting section which detects an inspection result of a display variation in each pixel of an electroluminescence display panel provided with a display section having a plurality of pixels arranged in a matrix, each of the plurality of pixels including an electroluminescence element having a diode structure and an element driving transistor which is connected to the electroluminescence element and controls a current that flows through the electroluminescence element; and a correcting section which corrects the display variation;

wherein the variation detecting section comprises:

an inspection signal generator which generates an inspection signal to be supplied to a pixel in a row to be inspected and supplies the inspection signal to the pixel in the inspected row at a predetermined timing during execution of a display in accordance with a video signal;

a current detector which detects a current that flows through the electroluminescence element in response to the inspection signal;

a volatile primary memory which stores a data corresponding to the current supplied from the current detector, a selector which selectively supplies to the primary memory a data read out from a non-volatile secondary memory which stores and maintains therein the data stored in the primary memory during when an apparatus power supply is turned off; and wherein the correcting section executes a correction with respect to the video signal for each pixel in accordance with the data read out from the primary memory of a memory section;

wherein during a blanking period, the inspection signal generator supplies, as the inspection signal to the pixel in the inspected row, an inspection ON signal and also an inspection OFF signal that sets the electroluminescence element to a non-emission level;

a current detection amplifier detects an ON current obtained during application of the inspection ON signal and an OFF current obtained during application of the inspection OFF signal; and the memory section stores a data corresponding to a current difference between the detected ON current and OFF current;

wherein the electroluminescence elements in the plurality of pixels have a common cathode;

wherein the current detector detects cathode current at the common cathode; and wherein after inspection, the video signal that was previously supplied and used for driving the electroluminescence element is again supplied to the pixel that was inspected.

9. The electroluminescence display panel driving apparatus as defined in claim 8, wherein the current that flows through the electroluminescence element is a cathode current.

10. The electroluminescence display apparatus as defined in claim 1, wherein the data corresponding to a current is written into the primary memory during a horizontal blanking period or a vertical blanking period.

11. The electroluminescence display apparatus as defined in claim 1, wherein data stored in the primary memory is transferred to the secondary memory before the power supply is turned off.

12. The electroluminescence display panel driving apparatus as defined in claim 8, wherein the data corresponding to a current is written into the primary memory during a horizontal blanking period or a vertical blanking period.

13. The electroluminescence display panel driving apparatus as defined in claim 8, wherein data stored in the primary memory is transferred to the secondary memory before the power supply is turned off.

* * * * *